US006060228A

United States Patent [19]

Suzuki

[11] Patent Number: 6,060,228

[45] Date of Patent: May 9, 2000

[54] PHOTOTHERMOGRAPHIC ELEMENTS

[75] Inventor: Keiichi Suzuki, Kanagawa, Japan

[73] Assignee: Fuji Photo Film Co., Ltd., Minami-ashigara, Japan

[21] Appl. No.: 09/237,913

[22] Filed: Jan. 27, 1999

[30] Foreign Application Priority Data

Feb. 6, 1998 [JP] Japan ..... 10-041300

[51] Int. Cl.[7] ..... G03C 1/83; G03C 1/835

[52] U.S. Cl. ..... 430/522; 430/537; 430/619

[58] Field of Search ..... 430/522, 537, 430/619, 531

[56] References Cited

U.S. PATENT DOCUMENTS

| | | | |
|---|---|---|---|
| 3,653,905 | 4/1972 | Depooter et al. | 430/522 |
| 5,459,265 | 10/1995 | Wariishi et al. | 430/522 |
| 5,545,515 | 8/1996 | Murray et al. | 430/619 |
| 5,641,617 | 6/1997 | Nishio | 430/522 |
| 5,922,523 | 7/1999 | Helber et al. | 430/522 |
| 5,928,849 | 7/1999 | Wheeler et al. | 430/522 |

FOREIGN PATENT DOCUMENTS

| | | |
|---|---|---|
| 0778493A1 | 6/1997 | European Pat. Off. . |
| 7-43851 | 2/1995 | Japan . |

*Primary Examiner*—Richard L. Schilling
*Attorney, Agent, or Firm*—Birch, Stewart, Kolasch & Birch, LLP

[57] ABSTRACT

In a photothermographic element comprising a photosensitive layer containing an organic silver salt, a silver halide, and a reducing agent on one surface of a support, and a back layer on the other surface of the support, the outermost back layer is based on a polymer latex binder, and the back layer contains a dye of formula (I) satisfying a specific maximum absorption wavelength relationship. The element produces an image with high Dmax, ultrahigh contrast, satisfactory resolution, and minimized residual color.

5 Claims, No Drawings

PHOTOTHERMOGRAPHIC ELEMENTS

This invention relates to photothermographic elements and more particularly, to photothermographic elements for use as photographic printing plates and for use with scanners and image setters. Furthermore, it relates to photothermographic elements for use as photographic printing plates and capable of forming images with a high maximum density (Dmax).

BACKGROUND OF THE INVENTION

One well-known method for the exposure of photographic photosensitive elements is an image forming method of the scanner system comprising the steps of scanning an original to produce image signals, subjecting a photographic silver halide photosensitive element to exposure in accordance with the image signals, and forming a negative or positive image corresponding to the image of the original.

There is a desire to have a procedure of providing outputs of a scanner to a film and directly printing on a printing plate without a transfer step as well as a scanner photosensitive element having ultrahigh contrast with respect to a scanner light source having a soft beam profile.

There are known a number of photosensitive elements having a photosensitive layer on a support wherein images are formed by imagewise exposure. Among these, a technique of forming images through heat development is known as a system capable of simplifying image forming means and contributing to the environmental protection.

From the contemporary standpoints of environmental protection and space saving, it is strongly desired in the photomechanical process field to reduce the quantity of spent solution. Needed in this regard is a technology relating to photothermographic elements for use in reprophotography which can be effectively exposed by means of laser scanners or laser image setters and produce distinct black images having high resolution and sharpness. These photothermographic elements offer to the customer a simple thermographic system which eliminates a need for solution type chemical agents and is not detrimental to the environment.

The technology of forming images through heat development is disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969. These photothermographic elements generally contain a reducible non-photosensitive silver source (e.g., organic silver salt), a catalytic amount of a photocatalyst (e.g., silver halide), and a reducing agent for silver, typically dispersed in an organic binder matrix. Photothermographic elements are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the reducible silver salt in exposed regions provides black images in contrast to unexposed regions, forming an image.

Photothermographic elements of this type are well known in the art. In most of these elements, photosensitive layers are formed by applying coating solutions based on organic solvents such as toluene, methyl ethyl ketone (MEK) and methanol, followed by drying. The use of organic solvents is not only harmful to workers in the manufacturing procedure, but disadvantageous because of the cost for recovery and disposal of the solvents.

It is contemplated to form photosensitive layers using coating solutions based on water solvent which eliminates such concern. Such photosensitive layers are sometimes referred to as "aqueous photosensitive layers," hereinafter. For example, JP-A 52626/1974 and 116144/1978 disclose the use of gelatin as the binder. JP-A 151138/1975 discloses polyvinyl alcohol as the binder. Further, JP-A 61747/1985 discloses a combined use of gelatin and polyvinyl alcohol. Besides, JP-A 28737/1983 discloses a photosensitive layer containing water-soluble polyvinyl acetal as the binder.

It is true that the use of these binders has great environmental and economical advantages in that photosensitive layers can be formed using coating solutions based on water solvent.

However, the use of such polymers as gelatin, polyvinyl alcohol and water-soluble polyacetal as the binder results in photosensitive materials which are of extremely low commodity worth in that a coating whose surface quality is practically acceptable is not available since these polymers are less compatible with the organic silver salt, that the silver tone of developed areas becomes brown or yellow and far from the essentially favorable black and that exposed areas have a low blackened density and unexposed areas have a high density.

There is a desire to develop a photothermographic element or aqueous photosensitive element having environmental and economic benefits, good coating surface quality, acceptable silver tone and satisfactory photographic properties (especially high Dmax) upon development.

In general, photothermographic elements undergo dimensional shrinkage or expansion during heat development. Such dimensional changes give rise to a serious problem against precise multi-color printing when the film is used as a photographic printing plate. The dimensional changes also cause variations in image density and seriously affect so especially in the case of fine images like photographic printing halftone images. Improvements in these problems associated with heat development are desired.

In order that photothermographic material produce an image faithful to exposure and having high resolution, it is effective to add an anti-irradiation dye or provide an anti-halation layer like the conventional wet system photographic silver halide photosensitive material. The anti-irradiation dye is mainly added to the photosensitive layer while the anti-halation layer is disposed between the support and the photosensitive layer or on that side of the support remote from the photosensitive layer. For example, where an output of a near infrared laser is to be recorded, a dye having absorption in the infrared region is necessary. Exemplary infrared dyes include indolenine cyanine dyes as described in JP-A 182640/1992 and dihydroperimidine squarylium dyes having squaric acid bonded to a dihydroperimidine nucleus at its para-position as described in U.S. Pat. No. 5,380,635.

U.S. Pat. No. 5,545,515 describes a photothermographic material comprising a hydrazine derivative of specific structure. It is also disclosed that an indolenine cyanine dye is added to an anti-halation or back layer. However, there is not available a dye which can prevent irradiation within the photosensitive layer or prevent halation between the photosensitive layer and the support. To produce an ultrahigh contrast image faithful to exposure, an anti-irradiation or anti-halation dye having no influence on image formation within the photosensitive layer is needed. Even in the anti-halation layer on the back side, some dyes give rise to the problem of residual color or resolution decline.

SUMMARY OF THE INVENTION

An object of the present invention is to provide a photothermographic element capable of forming images having high Dmax, ultrahigh contrast, satisfactory resolution, and minimal residual color.

According to the invention, there is provided a photothermographic element comprising a support having a pair of opposed surfaces, a photosensitive layer containing an organic silver salt, a silver halide, and a reducing agent on one surface of the support, and at least one back layer on the other surface of the support. The outermost layer of the at least one back layer is based on a binder containing at least 50% by weight, preferably at least 70% by weight of a polymer latex. The back layer contains at least one dye of the following formula (I) which has a maximum absorption wavelength λmax (nm) in the layer satisfying the relationship represented by the following formula (II).

(I)

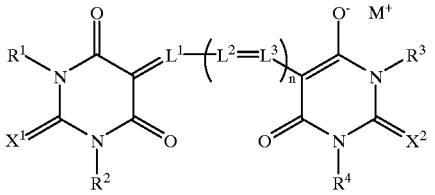

In formula (I), $R^1$, $R^2$, $R^3$, and $R^4$ are independently hydrogen, aliphatic, aromatic or heterocyclic groups, $X^1$ and $X^2$ are independently oxygen or sulfur atoms, $L^1$, $L^2$, and $L^3$ are independently methine groups, letter n is equal to 0, 1, 2 or 3, and $M^+$ is a hydrogen atom or an inorganic or organic cation, with the proviso that $R^1$, $R^2$, $R^3$, $R^4$, $L^1$, $L^2$, and $L^3$ are free of groups having ionizable proton or salts thereof, and at least one of $L^1$, $L^2$, and $L^3$ has a substituent or substituents in case of n=2.

$$\lambda max > \{\lambda max(DMF) + 20 \times (n+1)\} \quad \text{(II)}$$

In formula (II), λmax(DMF) is the maximum absorption wavelength (nm) of the dye in a dimethylformamide solution and n is as defined in formula (I).

DETAILED DESCRIPTION OF THE INVENTION

Photothermographic elements which form photographic images through heat development are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., item 2, 1969.

These photothermographic elements generally contain a reducible silver source (typically, organic silver salt), a catalytic amount of a silver halide, a reducing agent, and optionally, a toner for adjusting the tone of silver, typically dispersed in an organic binder matrix. Photothermographic elements are stable at room temperature. After exposure, they are developed by heating at an elevated temperature (e.g., 80° C. or higher). Upon heating, redox reaction takes place between the organic silver salt (functioning as an oxidizing agent) and the reducing agent to form silver. This redox reaction is promoted by the catalysis of a latent image produced in the silver halide by exposure. Silver formed by reaction of the organic silver salt in exposed regions provides black images in contrast to unexposed regions, forming an image. Since this reaction process proceeds without a need for water supply from the exterior, the process leaves no spent solution and is friendly to the environment.

In such a photothermographic element having a photosensitive layer on one surface of a support, according to the invention, a back layer is provided on the surface of the support remote from the photosensitive layer, that is, on the back surface, and a polymer latex is used as a main binder in the outermost layer of the back layer. The use of the polymer latex permits application using water solvent which is advantageous in the environmental and economical aspects, and improves mar resistance. In any layer on the back side, a dye of formula (I) having a maximum absorption wavelength λmax (nm) in the layer satisfying the relationship represented by formula (II) is contained. The inclusion of this dye ensures to form images free of residual color at a satisfactory resolution. A further improvement in resolution is achieved when an anti-irradiation dye is contained in the photosensitive layer. In contrast, if a dye outside the scope of formula (I), for example, an indolenine cyanine dye is used in the back layer, there can occur residual color and a drop of image quality including resolution.

The dyes used herein are described in detail.

Dye

The dyes used in the back layer are of the formula (I).

(I)

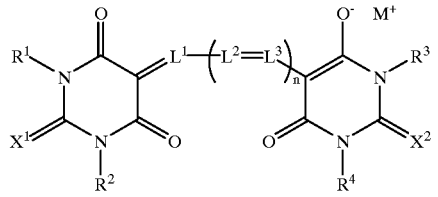

$R^1$, $R^2$, $R^3$, and $R^4$ each are hydrogen or an aliphatic, aromatic or heterocyclic group, $X^1$ and $X^2$ each are an oxygen or sulfur atom, $L^1$, $L^2$, and $L^3$ each are a methine group, letter n is equal to 0, 1, 2 or 3, and $M^+$ is a hydrogen atom or an inorganic or organic cation, with the proviso that $R^1$, $R^2$, $R^3$, $R^4$, $L^1$, $L^2$, and $L^3$ are free of groups having ionizable proton or salts thereof, and at least one of $L^1$, $L^2$, and $L^3$ has a substituent in case of n=2.

The maximum absorption wavelength λmax (nm) of the dye of formula (I) in the photothermographic element or back layer should satisfy the relationship represented by the formula (II):

$$\lambda max > \{\lambda max(DMF) + 20 \times (n+1)\} \quad \text{(II)}$$

wherein λmax(DMF) is the maximum absorption wavelength (nm) of the dye in a dimethylformamide solution and n is as defined in formula (I). Note that the λmax of the dye in the photothermographic element can be measured using a coated sample obtained by coating a support with a dye layer under the same conditions as in the preparation of the photothermographic element.

The dyes of formula (I) are described in detail. The aliphatic groups represented by $R_1$, $R^2$, $R^3$, and $R^4$ include straight, branched or cyclic alkyl, aralkyl and alkenyl groups of 1 to 10 carbon atoms, for example, methyl, ethyl, propyl, n-butyl, sec-butyl, t-butyl, isobutyl, n-pentyl, n-hexyl, n-heptyl, n-octyl, cyclohexyl, 2-ethylhexyl, 3-methylbutyl, cyclopentyl, 2-ethylbutyl, vinyl, allyl, and 1-propenyl. These groups may have substituents which include nitro groups, amino groups of 0 to 6 carbon atoms (such as unsubstituted amino, dimethylamino, and diethylamino), aryl groups of 6 to 10 carbon atoms (such as phenyl and 2-chlorophenyl), alkylthio groups of 1 to 8 carbon atoms (such as methylthio and ethylthio), carbonamide groups of 2 to 8 carbon atoms (such as acetylamino and propionylamino), oxycarbonylamino groups of 2 to 8 carbon atoms (such as methoxycarbonylamino and n-butoxycarbonylamino), carbamoyl groups of 2 to 8 carbon atoms (such as dimethylcarbamoyl and diethylcarbamoyl), and acyl groups of 2 to 8 carbon atoms (such as acetyl and propionyl).

The aromatic groups represented by $R^1$, $R^2$, $R^3$, and $R^4$ are preferably phenyl and naphthyl, more preferably phenyl. These groups may be substituted ones. In addition to the above-listed substituents that the alkyl groups represented by $R^1$, $R^2$, $R^3$, and $R^4$ may have, the substituents include alkyl groups of 1 to 4 carbon atoms (such as methyl, ethyl, n-propyl and t-butyl), halogen atoms (such as F, Cl and Br), cyano groups, alkoxy groups of 1 to 8 carbon atoms (such as methoxy, ethoxy, propoxy and phenoxy), ester groups of 2 to 8 carbon atoms (such as methoxycarbonyl and ethoxycarbonyl), and alkylsulfonyl groups of 1 to 8 carbon atoms (such as methanesulfonyl and ethanesulfonyl).

The heterocyclic groups represented by $R^1$, $R^2$, $R^3$, and $R^4$ are preferably 5- or 6-membered heterocycles containing nitrogen, oxygen or sulfur as the hetero atom, for example, pyridyl, pyrazinyl, imidazolyl, furyl, thienyl, pyrrole, indolyl, morpholyl, pyrrolidyl, and tetrazolyl. These heterocyclic groups may have the above-listed substituents that the aromatic groups represented by $R^1$, $R^2$, $R^3$, and $R^4$ may have.

$M^+$ is preferably H, Li, Na, K, Ca, triethylammonium or pyridinium. $M^+$ is used for simplicity's sake although calcium takes the form of Ca.

In case of n=0 or 1, the methine groups represented by $L^1$, $L^2$, and $L^3$ may be unsubstituted or have substituents such as methyl, ethyl, benzyl, phenyl, chloro, amino, piperidino and morpholino. In case of n=2, at least one of the methine groups represented by $L^1$, $L^2$, and $L^3$ should have a substituent or substituents such as methyl, ethyl, benzyl, phenyl, phenoxy, benzoyl, chloro, amino, piperidino, morpholino, hydroxy and dimethylcarbamoyl, and the methine groups may be joined together to form a 5- or 6-membered ring such as a cyclopentene, cyclohexene, 1-chlorocyclopentene, 1-chlorocyclohexene, 1-dimethylaminocyclopentene or 1-morpholinocyclopentene ring.

Letter n is preferably equal to 0, 1 or 2, and most preferably equal to 2. $X^1$ and $X^2$ are preferably oxygen atoms.

Preferred dyes of formula (I) are given by the structure of the following formula (Ia).

(Ia)

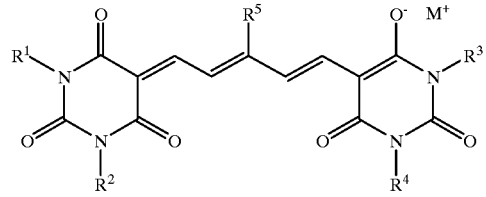

Herein, $R^1$ to $R^4$ and $M^+$ are as defined in formula (I). $R^1$ is as defined for the substituents on the methine groups represented by $L^1$, $L^2$, and $L^3$ in formula (I).

Illustrative, non-limiting, preferred examples of the dye of formula (I) are given below.

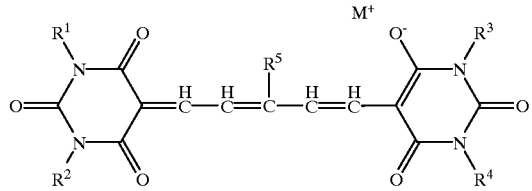

| No. | $R^1$ | $R^2$ | $R^3$ | $R^4$ | $R^5$ | $M^+$ |
|---|---|---|---|---|---|---|
| 1 | H | 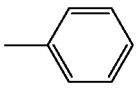 | H | 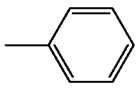 | $CH_3$ | $H^+$ |
| 1a | H | 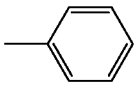 | H | 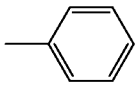 | $CH_3$ | 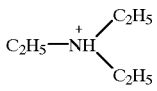 |
| 1n | H | 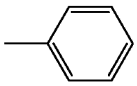 | H | 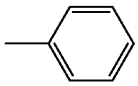 | $CH_3$ | $Na^+$ |
| 2 | H | 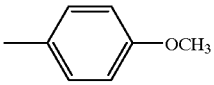 | H | 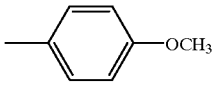 | $CH_3$ | $Na^+$ |

-continued
| No. | $R^1$ | $R^2$ | $R^3$ | $R^4$ | $R^5$ | $M^+$ |
|---|---|---|---|---|---|---|
| 3 | $CH_3$ | 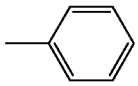 | $CH_3$ | 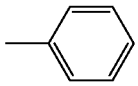 | $CH_3$ | $H^+$ |
| 4 | $CH_3$ | 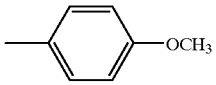 | $CH_3$ | 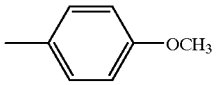 | $CH_3$ | $H^+$ |
| 5 | H | 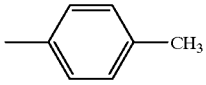 | H | 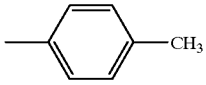 | $CH_3$ | $H^+$ |
| 6 | H | 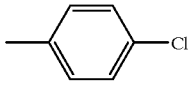 | H | 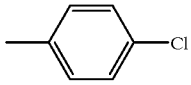 | $CH_3$ | $H^+$ |
| 7 | H | $nC_4H_9$ | H | $nC_4H_9$ | $CH_3$ | $H^+$ |
| 8 | $nC_4H_9$ | $nC_4H_9$ | $nC_4H_9$ | $nC_4H_9$ | $CH_3$ | $H^+$ |
| 9 | H | $nC_6H_{13}$ | H | $nC_6H_{13}$ | $CH_3$ | $H^+$ |
| 10 | H | 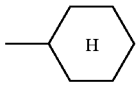 | H | 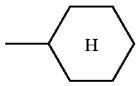 | $CH_3$ | $H^+$ |
| 14 | H | $—CH_2—CH=CH_2$ | H | $—CH_2—CH=CH_2$ | $CH_3$ | H |
| 15 | H | 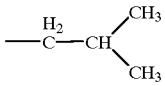 | H | 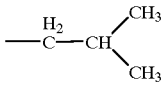 | $CH_3$ | H |
| 18 | H | 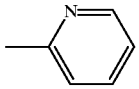 | H | 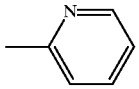 | $CH_3$ | $H^+$ |
| No. | $R^1$ | $R^2$ | $R^3$ | $R^4$ | $R^5$ | $M^+$ |
|---|---|---|---|---|---|---|
| 18a | H | 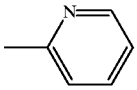 | H | 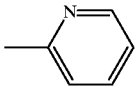 | $CH_3$ | $Na^+$ |
| 19 | H | 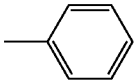 | H | 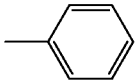 | 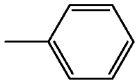 | $H^+$ |
| 20 | H | 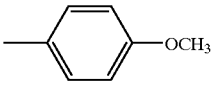 | H | 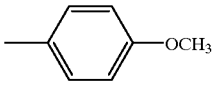 | 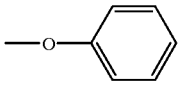 | $H^+$ |
| 21 | H | 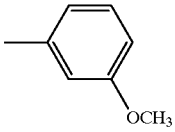 | H | 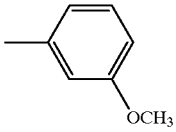 | $CH_3$ | $H^+$ |

-continued
| No. | $R^1$ | $R^2$ | $R^3$ | $R^4$ | $R^5$ | $M^+$ |
|---|---|---|---|---|---|---|
| 22 | H | 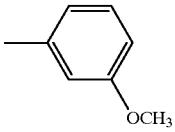 | H | 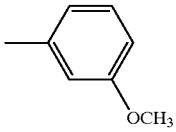 | $CH_3$ | $Na^+$ |
| 23 | H | 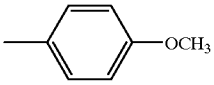 | H | 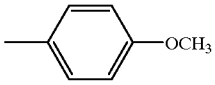 | $C_2H_5$ | $H^+$ |
| 24 | H | 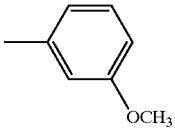 | H | 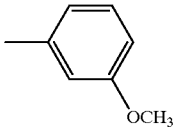 | $CH_3$ | $H^+$ |
| 25 | H | 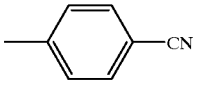 | H | 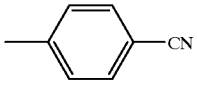 | $CH_3$ | $H^+$ |
| 26 | H | 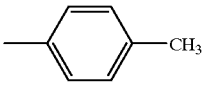 | H | 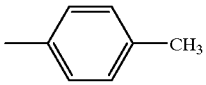 | $C_2H_5$ | 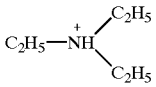 |
| 27 | H | 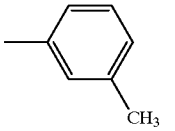 | H | 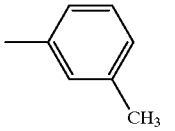 | $CH_3$ | $H^+$ |
| 28 | H | 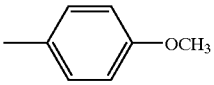 | H | 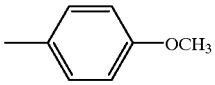 | 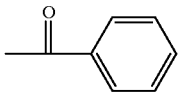 | 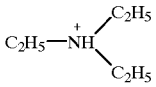 |
| 29 | H | 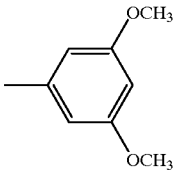 | H | 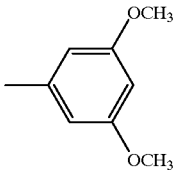 | $CH_3$ | $H^+$ |
| 30 | H | 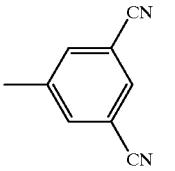 | H | 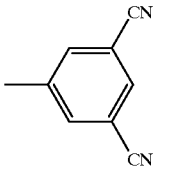 | $CH_3$ | $H^+$ |

| No. | $R^1$ | $R^2$ | $R^3$ | $R^4$ | $R^5$ | $M^+$ |
|---|---|---|---|---|---|---|
| 31 | H | 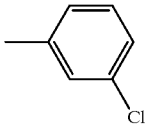 | H | 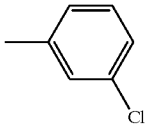 | $C_2H_5$ | $H^+$ |
| 32 | H | 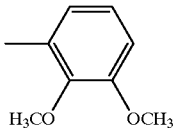 | H | 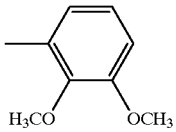 | $CH_3$ | $H^+$ |
| 33 | H | 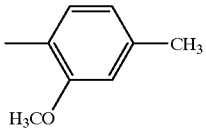 | H | 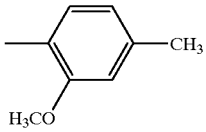 | $C_2H_5$ | $H^+$ |
| 34 | H | 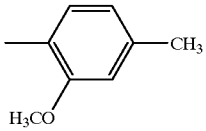 | H | 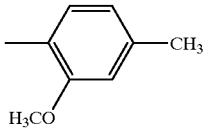 | 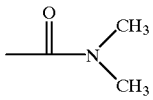 | $H^+$ |
| 35 | H | 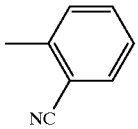 | H | 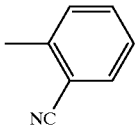 | $CH_3$ | $H^+$ |
| 36 | H | 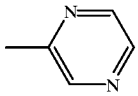 | H | 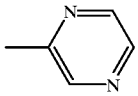 | $C_2H_5$ | $H^+$ |
| 37 | H | 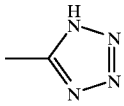 | H | 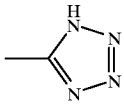 | $CH_3$ | $Na^+$ |
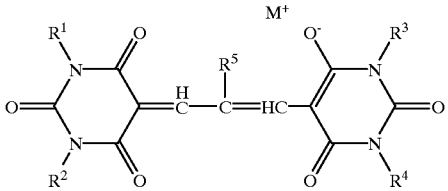
| No. | $R^1$ | $R^2$ | $R^3$ | $R^4$ | $R^5$ | $M^+$ |
|---|---|---|---|---|---|---|
| 38 | H | 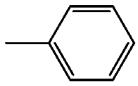 | H | 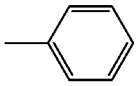 | H | $H^+$ |

-continued
| No. | $R^1$ | $R^2$ | $R^3$ | $R^4$ | $R^5$ | $M^+$ |
|---|---|---|---|---|---|---|
| 38a | H | 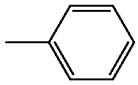 | H | 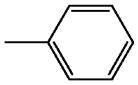 | H | 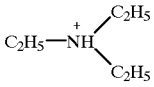 |
| 39 | H | 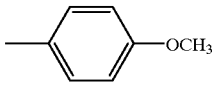 | H | 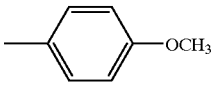 | H | $H^+$ |
| 40 | H | 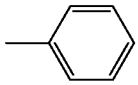 | H | 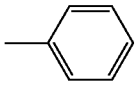 | $CH_3$ | $H^+$ |
| 41 | 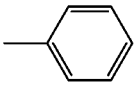 | 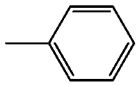 | 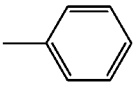 | 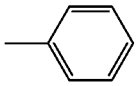 | H | $H^+$ |
| 42 | $nC_6H_{13}$ | $nC_6H_{13}$ | $nC_6H_{13}$ | $nC_6H_{13}$ | H | $H^+$ |
| 43 | $CH_3$ | 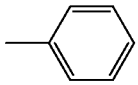 | $CH_3$ | 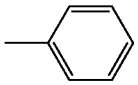 | $CH_3$ | $H^+$ |
| 44 | $CH_3$ | $nC_6H_{13}$ | $CH_3$ | $nC_6H_{13}$ | H | $H^+$ |
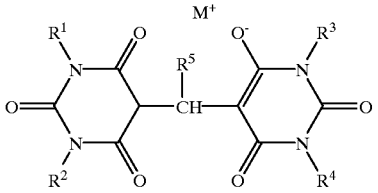
| No. | $R^1$ | $R^2$ | $R^3$ |
|---|---|---|---|
| 45 | $CH_3$ | 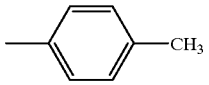 | $CH_3$ |
| 46 | H | 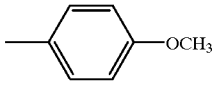 | H |
| 47 | 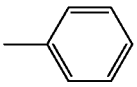 | 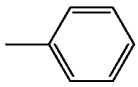 | 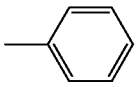 |
| 48 | H | 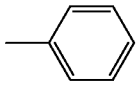 | H |

-continued
| | | | |
|---|---|---|---|
| 49 | H | 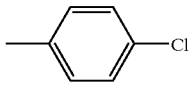 | H |
| 50 | $nC_6H_{13}$ | 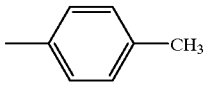 | $nC_6H_{13}$ |
| 51 | H | 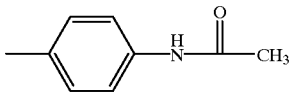 | H |
| 52 | H | 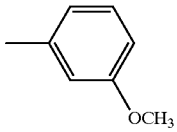 | H |
| 53 | H | 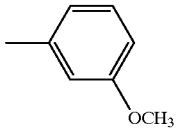 | H |
| No. | $R^4$ | $R^5$ | $M^+$ |
|---|---|---|---|
| 45 | 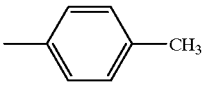 | H | $H^+$ |
| 46 | 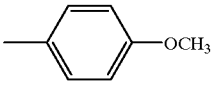 | H | $H^+$ |
| 47 | 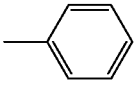 | H | $H^+$ |
| 48 | 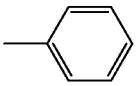 | H | 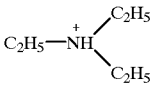 |
| 49 | 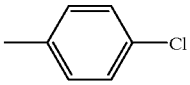 | H | 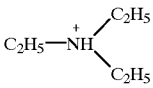 |
| 50 | 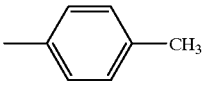 | H | 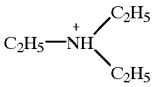 |
| 51 | 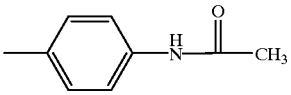 | H | 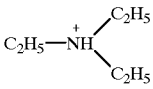 |

-continued

| | | | |
|---|---|---|---|
| 52 | 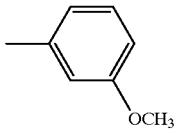 | H | 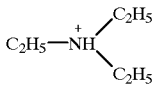 |
| 53 | 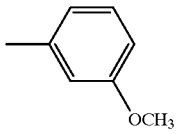 | $CH_3$ | 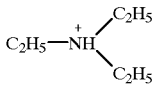 |

54

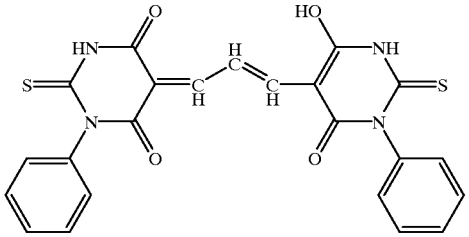

55a

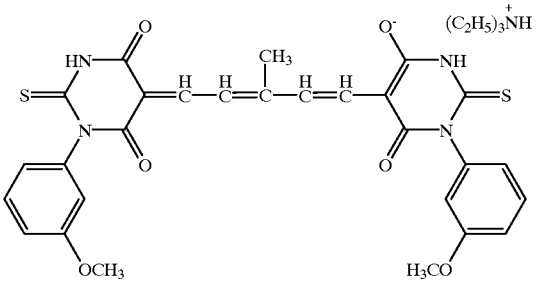

56

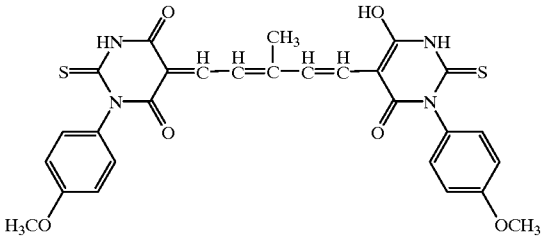

57a

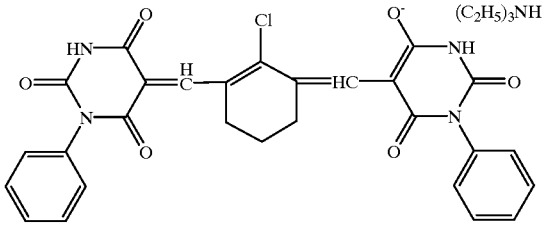

58a

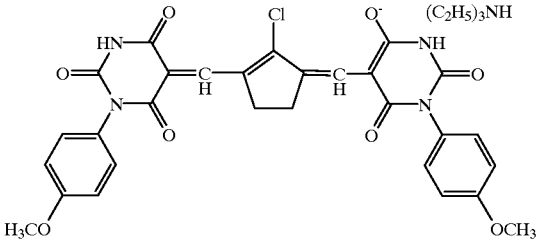

The dyes of formula (I) can be synthesized with reference to the following synthesis examples.

The dyes of formula (I) can be synthesized by methods well known in the art, for example, by condensation reaction between a corresponding appropriately substituted barbituric acid compound and a methine source for introducing a methine group or polymethine chain into a methine dye. With respect to the detail of compounds of this type, reference should be made to BP 1,133,986, U.S. Pat. No. 3,247,127 and U.S. Pat. No. 4,042,397. More particularly, for the introduction of monomethine groups, ethyl orthoformate, ethyl orthoacetate, N,N-diphenylformamidine hydrochloride, etc. may be used. For the introduction of trimethine chains, trimethoxypropene, tetramethoxypropene, malonaldehydedianil hydrochloride, etc. may be used. For the introduction of pentamethine groups, 4-methylglutaconaldehydedianil hydrochloride, 1-(2,4-dinitrobenzene)-4-methylpyridinium chloride, etc. may be used.

Synthesis Example 1 (Synthesis of Dye 1)

A mixed suspension of 5.0 g of N-phenylbarbituric acid and 3.5 g of 4-methylglutaconaldehydedianil hydrochloride in 25 ml of dimethylformamide was water cooled, and 5.0 ml of triethylamine was added dropwise thereto. The mixture was agitated at the temperature for one hour, then at room temperature for a further one hour. To this reaction solution, a mixture of 25 ml of a 2N hydrochloric acid aqueous solution and 25 ml of methanol was slowly added whereupon crystals precipitated. The crystals were collected by filtration, washed with MeOH, and dried, yielding 7.0 g of Dye 1.

$\lambda max(DMF)$=618 nm, $\epsilon max$=1.57×10$^5$

Synthesis Example 2 (Synthesis of Dye 3)

The procedure of Synthesis Example 1 was repeated except that 5.2 g of 1-methyl-3-phenylbarbituric acid was used instead of N-phenylbarbituric acid, yielding 7.1 g of Dye 3.

$\lambda max(DMF)$=620 nm, $\epsilon max$=1.73×10$^5$

Synthesis Example 3 (Synthesis of Dye 22)

To a mixed suspension of 5.0 g of 1-p-methoxyphenylbarbituric acid and 2.7 g of malonaldehydedianil hydrochloride in 25 ml of dimethylformamide at room temperature, 4.4 ml of triethylamine was added dropwise. The mixture was agitated at the temperature for one hour. To this reaction solution, a mixture of 25 ml of a 2N hydrochloric acid aqueous solution and 25 ml of methanol was slowly added whereupon crystals precipitated. The crystals were collected by filtration, washed with MeOH, and dried, yielding 6.0 g of Dye 22.

$\lambda max(DMF)$=492 nm, $\epsilon max$=1.12×10$^5$

Synthesis Example 4 (Synthesis of Dye 25)

The procedure of Synthesis Example 3 was repeated except that 6.3 g of 1,3-dihexylbarbituric acid was used instead of 1-p-methoxyphenylbarbituric acid, yielding 6.8 g of Dye 25.

$\lambda max(DMF)$=502 nm, $\epsilon max$=8.62×10$^4$

Synthesis Example 5 (Synthesis of Dye 28)

A mixture of 5.0 g of 1-methyl-3-p-tolylbarbituric acid, 2.1 g of ethyl orthoformate, and 25 ml of acetic acid was heated and agitated for 3 hours over a steam bath (internal temperature 80–85° C.). The reaction solution was cooled to room temperature and poured into 100 ml of cold methanol whereupon crystals precipitated. The crystals were collected by filtration, washed with methanol, and dried, yielding 3.8 g of Dye 28.

$\lambda max(DMF)$=386 nm, $\epsilon max$=3.50×10$^4$

Barbituric acid compounds of the general formula (IV), which are starting reactants from which the dyes used in the invention are prepared, can be synthesized by reacting urea derivatives of the general formula (III) with malonic acid in the presence of acetic anhydride or with malonates under basic conditions in a conventional manner. For the detail of synthesis of these compounds, reference should be made to "New Experimental Chemistry Series," Vol. 14, Maruzene K.K. and J. Am. Chem. Soc., 78, 6185 (1956). R's and X's in formulas (III) and (IV) are as defined in formula (I).

(III)

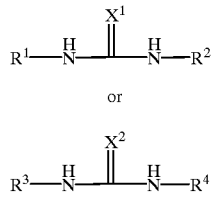

(IV)

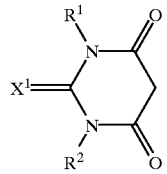

or

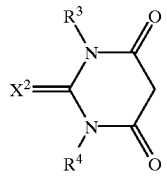

The dyes or compounds falling within the scope of formula (I) and having an absorption wavelength in the photothermographic element satisfying formula (II) can be formulated by (1) a procedure of preparing a solid particle dispersion of the dye or (2) a procedure of preparing a solution of the dye, followed by coating and drying.

In preparing a solid particle dispersion of the dye, a choice may be made among various dispersing machines including ball mills, sand mills, colloidal mills, vibrating ball mills, planetary ball mills, jet mills, roll mills, Manton Gaulin, microfluidizers, and disk impeller mills as described in JP-A 92716/1977 and WO 88/04794. Vertical or lateral media agitating mills are preferred. In any case, a solvent, typically water is preferably used, and more preferably, a surfactant is used for promoting dispersion. As the dispersing surfactant, anionic surfactants as described in JP-A 92716/1977 and WO 88/04794, and anionic polymers as described in Japanese Patent Application No. 121749/1991 may be used. If desired, nonionic and cationic surfactants are used. Of these, anionic polymers and anionic surfactants are preferred.

Alternatively, the dye according to the invention is dissolved in a suitable solvent, to which a poor solvent is added for causing microcrystals of the dye to precipitate. A dispersing surfactant may be used in this case too. In another procedure, the dye is first dissolved in a solvent by controlling the pH thereof, and the pH is then changed so as to cause microcrystals of the dye to precipitate. Fine particles of the dye according to the invention in such a dispersion should preferably have a mean particle size of 0.005 to 10 $\mu$m, more preferably 0.01 to 1 $\mu$m, and further preferably 0.01 to 0.5 $\mu$m or in some cases, 0.01 to 0.1 $\mu$m. Fine particles of the dye are preferably mono-disperse.

In preparing a dispersion of the dye of formula (I), the dye solid may be directly dispersed without any pretreatment.

Preferably, the dye solid in wet conditions as obtained from its synthesis procedure is subject to dispersion. If necessary, the dye solid is heat treated before and/or after dispersion. Better results are obtained by effecting heat treatment at least after dispersion. The heating method is not particularly limited insofar as heat is applied to the dye solid. The temperature of heat treatment is preferably at least 40° C. while the temperature above which the dye can be decomposed is the upper limit. Preferably the upper limit is 250° C. More preferably the heating temperature is from 50 to 150° C. The heating time is not critical insofar as the dye is not decomposed. Usually the heating time is 15 minutes to 1 week, preferably 1 hour to 4 days. For better results, heat treatment is preferably carried out in a solvent. There may be used any type of solvent in which the dye of formula (I) is not substantially soluble. Exemplary solvents are water, alcohols (e.g., methanol, ethanol, isopropyl alcohol, butanol, isoamyl alcohol, octanol, ethylene glycol, diethylene glycol and ethyl cellosolve), ketones (e.g., acetone and methyl ethyl ketone), esters (e.g., ethyl acetate and butyl acetate), alkylcarboxylic acids (e.g., acetic acid and propionic acid), nitriles (e.g., acetonitrile), and ethers (e.g., dimethoxyethane, dioxane, and tetrahydrofuran).

Heat treatment may be carried out in the co-presence of an organic carboxylic acid. Such organic carboxylic acids include alkylcarboxylic acids (e.g., acetic acid and propionic acid), carboxymethyl celluloses (CMC), arylcarboxylic acids (e.g., benzoic acid and salicylic acid). The amount of the organic carboxylic acid is 0.5 to 100 times the weight of the dye of formula (I) when used as the solvent, and 0.05 to 100% by weight based on the weight of the dye of formula (I) when a solvent other than the organic carboxylic acid is present and the organic carboxylic acid is added thereto.

For saving the equipment and expense required for the step of preparing a solid dispersion of the dye, the other possible procedure is to prepare a solution of the dye, followed by coating and drying. A solution of the dye may be prepared either by simply dissolving the dye in water to form an aqueous solution of the dye if $M^+$ in formula (I) is a salt other than proton, or by dissolving the dye in a solvent with the aid of a suitable basic compound (such as sodium hydroxide or triethylamine) if $M^+$ in formula (I) is proton. In this regard, it is preferred that $M^+$ in formula (I) is a salt other than proton. The solution of the dye may be applied after adding hydrophilic colloid (e.g., gelatin) to the dye solution as is often the case with the conventional methods for preparing photosensitive materials, or the dye solution may be directly applied.

In the photothermographic element according to the invention having a photosensitive layer on a support, the dye is contained in a layer (back layer) formed on the side of the support located remote from the photosensitive layer. The dye may also be added on the photosensitive layer-bearing side, for example, to a layer below the emulsion layer or on the back surface of the support for anti-halation purpose, or to the silver halide emulsion layer for anti-irradiation purpose, or to an intermediate layer (for example, an intermediate layer interleaved between different color sensitive emulsion layers or an intermediate layer interleaved between substantially identical color sensitive emulsion layers) or a protective layer as a filter dye.

The preferred amount of the dye added to the solution is 0.1 to 20% by weight based on the overall weight of the solution.

Also preferably, the dye is added such that its coverage per square meter of the element is 0.1 to 1,000 mg/m$^2$, especially 1 to 200 mg/m$^2$.

When a binder is used, the amount of the dye is usually 0.1 to 100%, preferably 0.5 to 50%, more preferably 1 to 30% by weight based on the weight of the binder.

For exposure with an IR semiconductor laser (780, 830 nm), the dye is added to the element so as to provide an absorbance of more than 0.2, preferably at least 0.6 (and usually up to 2.0) at the exposure wavelength in the range of 750 to 1,500 nm. The dye may be used alone or a mixture of two or more dyes may be used. Also preferably, the dye is added to the element so as to provide an absorbance of less than 0.5, preferably up to 0.1 in the visible region of 300 to 700 nm after heat development.

Back layer

Next, the back layer is described in detail.

In the photothermographic element according to the invention having a photosensitive layer on one side of a support, a layer formed on the other side of the support located remote from the photosensitive layer is designated a back layer. The back layer consists of one or more layers, the outermost layer of which contains a polymer latex in an amount of at least 50% by weight of the entire binder. The "polymer latex" is a dispersion of water-insoluble hydrophobic polymer microparticulates in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The polymer latex used herein may be either a latex of the conventional uniform structure or a latex of the so-called core/shell type. In the latter case, better results are sometimes obtained when the core and the shell have different glass transition temperatures.

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the polymer latex according to the invention include acrylic resins, vinyl acetate resins, polyester resins, polyurethane resins, rubbery resins, vinyl chloride resins, vinylidene chloride resins, polyolefin resins, and copolymers thereof. The polymer may be linear, branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low mechanical strength as the binder whereas polymers with a too higher molecular weight are difficult to form films.

Illustrative examples of the polymer latex which can be used as the binder in the outermost back layer of the photothermographic element of the invention include latexes of methyl methacrylate/ethyl acrylate/methacrylic acid copolymers, latexes of methyl methacrylate/2-ethylhexyl acrylate/styrene/acrylic acid copolymers, latexes of styrene/butadiene/acrylic acid copolymers, latexes of styrene/butadiene/divinyl benzene/methacrylic acid copolymers, latexes of methyl methacrylate/vinyl chloride/acrylic acid copolymers, and latexes of vinylidene chloride/ethyl acrylate/acrylonitrile/methacrylic acid copolymers. These polymers or polymer latexes are commercially available. Exemplary acrylic resins are Sebian A-4635, 46583 and 4601 (Daicell Chemical Industry K.K.), Nipol Lx811, 814, 820, 821, and 857 (Nippon Zeon K.K.), and Jurimer ET-410 (Nippon Junyaku K.K.). Exemplary polyester resins are FINETEX ES650, 611, 675, and 850 (Dai-Nippon Ink & Chemicals K.K.) and WD-size and WMS (Eastman Chemical Products, Inc.). Exemplary polyurethane resins are HYDRAN AP10, 20, 30 and 40 (Dai-Nippon Ink & Chemicals K.K.). Exemplary rubbery resins are LACSTAR 7310K, 3307B, 4700H, and 7132C (Dai-Nippon Ink & Chemicals K.K.) and Nipol Lx416, 410, 438C, and 2507 (Nippon Zeon K.K.). Exemplary vinyl chloride resins are Nipol G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.). These polymers may be used alone or in admixture of two or more.

The back layer according to the invention may be of single or multi-layer construction although the multi-layer construction is preferred in order to afford multiple functions by incorporating an antistatic layer, a matte agent layer or the like. In the case of multi-layer construction, the outermost layer is a layer formed of a hydrophobic polymer originating from the polymer latex. More preferably, the outermost layer contains the polymer latex in an amount of at least 70% by weight of the entire binder. It is noted that as the hydrophobic polymer, any of polyvinyl acetal, polyvinyl chloride, polyvinyl acetate, cellulose acetate, polyolefins, polystyrene, polyacrylonitrile and polycarbonate may be used in combination with the above-mentioned polymer latex.

In the outermost back layer according to the invention, a hydrophilic polymer may be added in an amount of up to 50% by weight, preferably up to 30% by weight of the entire binder. Such hydrophilic polymers are gelatin, polyvinyl alcohol, methyl cellulose, hydroxypropyl cellulose, carboxymethyl cellulose, and hydroxypropyl methyl cellulose.

In the practice of the invention, the outermost back layer is preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide, and ethyl acetate. Beside water, exemplary solvent compositions include a 90/10 mixture of water/methanol, a 70/30 mixture of water/methanol, a 90/10 mixture of water/ethanol, a 90/10 mixture of water/isopropanol, a 95/5 mixture of water/dimethylformamide, a 80/15/5 mixture of water/methanol/dimethylformamide, and a 90/5/5 mixture of water/methanol/dimethylformamide, all expressed in a weight ratio.

In the practice of the invention, a matte agent may be added to the back layer or a surface protective layer for the back layer for improving transportation. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-$\alpha$-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 $\mu$m to 30 $\mu$m are preferably used in the practice of the invention. The particle size distribution of the matte agent may be either narrow or wide. Nevertheless, since the haze and surface luster of coating are largely affected by the matte agent, it is preferred to adjust the particle size, shape and particle size distribution of a matte agent as desired during preparation of the matte agent or by mixing plural matte agents.

In the practice of the invention, the back layer should preferably have a degree of matte as expressed by a Bekk smoothness of 1 to 2,000 seconds, more preferably 10 to 1,000 seconds.

In the invention, the matte agent is preferably added to a layer of the back layer other than the outermost layer. In this case, the outermost layer should preferably have a thickness of at least 0.05 $\mu$m, more preferably at least 0.2 $\mu$m while the upper limit of thickness is about 10 $\mu$m, though not critical.

The overall amount of binder in the back layer is preferably in the range of 0.2 to 30 g/m$^2$, more preferably 1 to 15 g/m$^2$.

To the back layer according to the invention, a crosslinking agent for crosslinking, a surfactant for ease of application and other addenda may be added.

Illustrative, non-limiting examples of the crosslinking agent include melamine compounds and derivatives thereof such as dimethylol melamine, trimethylol melamine, tetramethylol melamine, pentamethylol melamine, hexamethylol melamine, hexamethylol melamine resin, trimethyol melamine resin, and trimethylol trimethoxymethylmelamine resin; aldehydes and derivatives thereof such as mucochloric acid, mucobromic acid, mucophenoxychloric acid, mucophenoxybromic acid, formaldehyde, glyoxazole, monomethylglyoxazole, 2,3-dihydroxy-1,4-dioxane, 2,3-dihydroxy-5-methyl-1,4-dioxane, succinaldehyde, 2,5-dimethoxytetrahydrofuran, and glutaraldehyde; active vinyl compounds such as divinylsulfone-N,N'-ethylenebis (vinylsulfonylacetamide), 1,3 -bis(vinylsulfonyl)-2-propanol, methylenebismaleimide, 5-acetyl-1,3-diacryloyl-hexahydro-s-triazine, 1,3,5-triacryloyl-hexahydro-s-triazine, and 1,3,5-trivinylsulfonyl-hexahydro-s-triazine; active halides such as the sodium salt of 2,4-dichloro-6-hydroxy-s-triazine, the sodium salt of 2,4-dichloro-6-(4-sulfoanilino)-s-triazine, 2,4-dichloro-6-(2-sulfoethylamino)-s-triazine, and N,N'-bis(2-chloroethylcarbamyl)piperadine; epoxy compounds such as bis(2,3-epoxypropyl)methylpropyl ammonium p-toluenesulfonate salt, 1,4-bis(2',3'-epoxypropyloxy) butane, 1,3,5-triglycidyl isocyanurate, and 1,3-diglycidyl-5-(γ-acetoxy-β-oxypropyl)isocyanurate, sorbitol polyglycidyl ethers, polyglycerol polyglycidyl ethers, pentaerythritol polyglycidyl ethers, diglycerol polyglycidyl ether, 1,3,5-triglycidyl(2-hydroxyethyl)isocyanurate, glycerol polyglycerol ethers, and trimethylolpropane polyglycidyl ethers; ethyleneimine compounds such as 2,4,6-triethylene-s-triazine, 1,6-hexamethylene-N,N'-bisethylene urea, and bis-β-ethyleneiminoethyl thioether; methanesulfonic acid esters such as 1,2-di(methanesulfonoxy)ethane, 1,4-di (methanesulfonoxy)butane, and 1,5-di(methanesulfonoxy) pentane; carbodiimide compounds such as dicyclohexylcarbodiimide and 1-dicyclohexyl-3-(3-trimethylaminopropyl) carbodiimide hydrochloride; isoxazole compounds such as 2,5-dimethylisoxazole; inorganic compounds such as chromium alum and chromium acetate; dehydration condensation type peptide reagents such as N-carboethoxy-2-isopropoxy-1,2-dihydroquinoline and N-(1-morpholinocarboxy)-4-methylpyridinium chloride; active ester compounds such as N,N'-adipoyldioxydisuccinimide and N,N'-terephthaloyldioxydisuccinimide; isocyanates such as toluene-2,4-diisocyanate and 1,6-hexamethylene diisocyanate; and epichlorohydrin compounds such as polyamide-polyamine-epichlorohydrin reaction products. These compounds are added in amounts of 1 to 100%, preferably 5 to 80% by weight of the binder.

As the surfactant, any of nonionic, anionic, cationic and fluorochemical surfactants may be used. Examples include fluorochemical polymer surfactants as described in JP-A 170950/1987 and U.S. Pat. No. 5,380,644, fluorochemical surfactants as described in JP-A 244945/1985 and 188135/1988, polysiloxane surfactants as described in U.S. Pat. No. 3,885,965, and polyalkylene oxide and anionic surfactants as described in JP-A 301140/1994.

The back layer according to the invention is preferably rendered antistatic. Effective means for the antistatic purpose is the provision of an antistatic layer containing conductive polymers, ionic or nonionic surfactants, colloidal silica, metal oxides or compound oxides. Of these, metal oxides or compound oxides or fine particles of metal oxide or compound oxide containing a minor amount of hetero atom are especially preferred. Antistatic layers containing such particles are described in JP-B 20736/1989, JP-A 20033/1986, and JP-A 39651/1992. From the standpoint of improved transparency, it is preferred to use acicular particles having an aspect ratio (major axis/minor axis ratio) of from 3/1 to 50/1, especially from 10/1 to 50/1. These acicular particles preferably have a minor axis or breadth in the range of 0.001 to 0.1 μm, especially 0.01 to 0.02 μm and a major axis or length in the range of 0.1 to 5.0 μm, especially 0.1 to 2.0 μm.

Examples of the conductive metal oxide particles include ZnO, $TiO_2$, $SnO_2$, $Al_2O_3$, $In_2O_3$, MgO, BaO, and $MoO_3$, and compound oxides thereof, which may contain a hetero atom. Preferred metal oxides are $SnO_2$, ZnO, $Al_2O_3$, $TiO_2$, $In_2O_3$, MgO, more preferably $SnO_2$, ZnO, $In_2O_3$, and $TiO_2$, with $SnO_2$ being most preferred. Examples of the metal oxide containing a minor amount of a hetero atom are ZnO containing Al or In, $TiO_2$ containing Nb or Ta, $In_2O_3$ containing Sn, and $SnO_2$ containing Sb, Nb or halogen atom wherein the metal oxide is doped with 0.01 to 30 mol %, preferably 0.1 to 10 mol % of the hetero atom. Less than 0.01 mol % of the hetero atom would be too small to impart sufficient conductivity to oxide or compound oxide whereas more than 30 mol % of the hetero atom would increase the degree of blackening of particles so that the antistatic layer becomes blackened and unsuitable for the photothermographic use. Accordingly, metal oxides and compound metal oxides containing a minor amount of hetero atom are preferred as the conductive metal oxide particles. They may have oxygen defects in their crystal structure.

Preferred as the conductive metal oxide particles containing a minor amount of hetero atom are $SnO_2$ particles doped with antimony, especially $SnO_2$ particles doped with 0.2 to 2.0 mol % of antimony.

Accordingly, metal oxide particles having minor and major axis dimensions within the above-defined range, typically $SnO_2$ particles doped with antimony are advantageous in forming a transparent antistatic layer having good conductivity.

By the use of acicular metal oxide particles having specific minor and major axis dimensions, typically $SnO_2$ particles doped with antimony, a transparent, high conductivity antistatic layer is obtained for the following reason. The acicular metal oxide particles are contained in the antistatic layer such that their major axis extends parallel to the surface of the layer and over a substantial length while their minor axis occupies only a fraction of the thickness of the layer. Since the acicular metal oxide particles are, of course, longer in the major axis direction, they are likely to contact with each other as compared with ordinary spherical particles, so that a higher conductivity is obtained even with a less loading. Therefore, the acicular metal oxide particles succeed in reducing the surface electrical resistivity of the layer without detracting from transparency.

Moreover, since the minor axis or breadth is generally at most equal to the thickness of the antistatic layer, the acicular metal oxide particles do not protrude beyond the surface of the layer and even when protrude, the protrusion is small enough to be fully covered with a surface layer to be formed over the antistatic layer. This leads to the superiority that no dusting or separation of such protrusions from the layer occurs during transportation of the support for the manufacture of the photothermographic element or during transportation of the photothermographic element for exposure and development.

Next, the organic silver salt, silver halide, and reducing agent used in the photothermographic element of the invention are described.

Organic Silver Salt

The organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. The silver-providing substance preferably constitutes about 5 to 70% by weight of the image forming layer (or photosensitive layer). Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274, and silver salts of thion compounds such as a silver salt of 3-(3-carboxyethyl)-4-methyl-4-thiazoline-2-thion as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. In the practice of the invention, grains should preferably have a minor axis of 0.01 $\mu$m to 0.20 $\mu$m and a major axis of 0.10 $\mu$m to 5.0 $\mu$m, more preferably a minor axis of 0.01 $\mu$m to 0.15 $\mu$m and a major axis of 0.10 $\mu$m to 4.0 $\mu$m. The grain size distribution of the organic silver salt is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

For the purpose of obtaining a solid particle dispersion of an organic silver salt having a high S/N ratio and a small particle size and free of agglomeration, use is preferably made of a dispersion method involving the steps of converting a water dispersion containing an organic silver salt as an image forming medium, but substantially free of a photosensitive silver salt into a high pressure, high speed flow, and causing a pressure drop to the flow. Thereafter, the dispersion is mixed with an aqueous solution of a photosensitive silver salt, thereby preparing a photosensitive image forming medium coating solution.

When a photothermographic element is prepared using this coating solution, the resulting photothermographic element has a low haze, low fog and high sensitivity. In contrast, if a photosensitive silver salt is co-present when an organic silver salt is dispersed in water by converting into a high pressure, high speed flow, then there result a fog increase and a substantial sensitivity decline. If an organic solvent is used instead of water as the dispersing medium, then there result a haze increase, a fog increase and a sensitivity decline. If a conversion technique of converting a portion of an organic silver salt in a dispersion into a photosensitive silver salt is employed instead of mixing a photosensitive silver salt, then there results a sensitivity decline.

The water dispersion which is dispersed by converting into a high pressure, high speed flow should be substantially free of a photosensitive silver salt. The content of photosensitive silver salt is less than 0.1 mol % based on the non-photosensitive organic silver salt. The positive addition of photosensitive silver salt is avoided.

With respect to the solid dispersing technology and apparatus employed in carrying out the above-described dispersion method of the invention, reference should be made to Kajiuchi and Usui, "Dispersed System Rheology and Dispersing Technology," Shinzansha Publishing K.K., 1991, pp. 357–403; and Tokai Department of the Chemical Engineering Society Ed., "Progress of Chemical Engineering, Volume 24," Maki Publishing K.K., 1990, pp. 184–185. According to the dispersion method recommended above, a water dispersion liquid containing at least an organic silver salt is pressurized by a high pressure pump or the like, fed into a pipe, and passed through a narrow slit in the pipe whereupon the dispersion liquid is allowed to experience an abrupt pressure drop, thereby accomplishing fine dispersion.

Such a high pressure homogenizer which is used in the practice of the invention is generally believed to achieve dispersion into finer particles under the impetus of dispersing forces including (a) "shear forces" exerted when the dispersed phase is passed through a narrow gap under high pressure and at a high speed and (b) "cavitation forces" exerted when the dispersed phase under high pressure is released to atmospheric pressure. As the dispersing apparatus of this type, Gaulin homogenizers are known from the past. In the Gaulin homogenizer, a liquid to be dispersed fed under high pressure is converted into a high-speed flow through a narrow slit on a cylindrical surface and under that impetus, impinged against the surrounding wall surface, achieving emulsification and dispersion by the impact forces. The pressure used is generally 100 to 600 kg/cm$^2$ and the flow velocity is from several meters per second to about 30 m/sec. To increase the dispersion efficiency, improvements are made on the homogenizer as by modifying a high-flow-velocity section into a saw-shape for increasing the number of impingements. Apart from this, apparatus capable of dispersion at a higher pressure and a higher flow velocity were recently developed. Typical examples of the advanced dispersing apparatus are available under the trade name of Micro-Fluidizer (Microfluidex International Corp.) and Nanomizer (Tokushu Kika Kogyo K.K.).

Examples of appropriate dispersing apparatus which are used in the practice of the invention include Micro-Fluidizer M-110S-EH (with G10Z interaction chamber), M-110Y (with H10Z interaction chamber), M-140K (with G10Z interaction chamber), HC-2000 (with T50Z or M250Z interaction chamber), HC-5000 (with L30Z or H230Z interaction chamber), and HC-8000 (with E230Z or L30Z interaction chamber), all available from Microfluidex International Corp.

Using such apparatus, a water dispersion liquid containing at least an organic silver salt is pressurized by a high pressure pump or the like, fed into a pipe, and passed through a narrow slit in the pipe for applying a desired pressure to the liquid and thereafter, the pressure within the pipe is quickly released to atmospheric pressure whereby the dispersion liquid experiences an abrupt pressure drop, thereby accomplishing the fine dispersion effect of the invention.

According to the invention, the organic silver salt dispersion can be dispersed to a desired particle size by adjusting a flow velocity, a differential pressure upon pressure drop, and the number of dispersing cycles. From the standpoints of photographic properties and particle size, it is preferable to use a flow velocity of 200 to 600 m/sec and a differential pressure upon pressure drop of 900 to 3,000 kg/cm$^2$, and especially a flow velocity of 300 to 600 m/sec and a differential pressure upon pressure drop of 1,500 to 3,000 kg/cm$^2$. The number of dispersing cycles may be selected as appropriate although it is usually 1 to 10. From the productivity standpoint, the number of dispersing cycles is 1 to about 3. It is not recommended from the standpoints of dispersibility and photographic properties to elevate the temperature of the water dispersion under high pressure. High temperatures above 90° C. tend to increase the particle size and the fog due to poor dispersion. Accordingly, in the preferred embodiment of the invention, a cooling step is provided prior to the conversion step and/or after the pressure drop step whereby the water dispersion is maintained at a temperature in the range of 5 to 90° C., more preferably 5 to 80° C. and most preferably 5 to 65° C. It is effective to use the cooling step particularly when dispersion is effected under a high pressure of 1,500 to 3,000 kg/cm$^2$. The cooling means used in the cooling step may be selected from various coolers, for example, double tube type heat exchangers, static mixer-built-in double tube type heat exchangers, multi-tube type heat exchangers, and serpentine heat exchangers, depending on the necessary quantity of heat exchange. For increasing the efficiency of heat exchange, the diameter, gage and material of the tube are selected as appropriate in consideration of the pressure applied thereto. Depending on the necessary quantity of heat exchange, the refrigerant used in the heat exchanger may be selected from well water at 20° C., cold water at 5 to 10° C. cooled by refrigerators, and if necessary, ethylene glycol/water at −30° C.

In the dispersing operation according to the invention, the organic silver salt is preferably dispersed in the presence of dispersants or dispersing agents soluble in an aqueous medium. The dispersing agents used herein include synthetic anionic polymers such as polyacrylic acid, acrylic acid copolymers, maleic acid copolymers, maleic acid monoester copolymers, and acryloylmethylpropanesulfonic acid copolymers; semi-synthetic anionic polymers such as carboxymethyl starch and carboxymethyl cellulose; anionic polymers such as alginic acid and pectic acid; anionic surfactants as described in JP-A 92716/1977 and WO 88/04794; compounds as described in Japanese Patent Application No. 350753/1995; well-known anionic, nonionic and cationic surfactants; well-known polymers such as polyvinyl alcohol, polyvinyl pyrrolidone, carboxymethyl cellulose, hydroxypropyl cellulose and hydroxypropylmethyl cellulose; and naturally occurring polymers such as gelatin. Of these, polyvinyl alcohol and water-soluble cellulose derivatives are especially preferred.

In general, the dispersant is mixed with the organic silver salt in powder or wet cake form prior to dispersion. The resulting slurry is fed into a dispersing machine. Alternatively, a mixture of the dispersant with the organic silver salt is treated to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g/m$^2$, more preferably about 1 to 3 g/m$^2$, as expressed by a silver coverage per square meter of the element.

Photosensitive Silver Halide

The halogen composition of photosensitive silver halide is not critical and may be any of silver chloride, silver chlorobromide, silver bromide, silver iodobromide, and silver iodochlorobromide. The halogen composition in grains may have a uniform distribution or a non-uniform distribution wherein the halogen concentration changes in a stepped or continuous manner. Silver halide grains of the core/shell structure are also useful. Such core/shell grains preferably have a multilayer structure of 2 to 5 layers, more preferably 2 to 4 layers. Silver chloride or silver chlorobromide grains having silver bromide localized at the surface thereof are also preferably used.

A method for forming the photosensitive silver halide according to the invention is well known in the art. Any of the methods disclosed in *Research Disclosure* No. 17029 (June 1978) and U.S. Pat. No. 3,700,458, for example, may be used. Illustrative methods which can be used herein are a method of adding a halogen-containing compound to a pre-formed organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller grain size for the purpose of minimizing white turbidity after image formation. Specifically, the grain size is up to 0.20 μm, preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The photosensitive silver halide grains used herein may contain any of metals or metal complexes belonging to Groups VII and VIII (or Groups 7 to 10) in the Periodic Table. Preferred metals or central metals of metal complexes belonging to Groups VII and VIII in the Periodic Table are rhodium, rhenium, ruthenium, osmium, and iridium. The metal complexes may be used alone or in admixture of complexes of a common metal or different metals. The content of metal or metal complex is preferably $1\times10^{-9}$ mol to $1\times10^{-2}$ mol, more preferably $1\times10^{-8}$ mol to $1\times10^{-4}$ mol, per mol of silver.

Illustrative metal complexes are those of the structures described in JP-A 225449/1995.

The rhodium compounds which can be used herein are water-soluble rhodium compounds, for example, rhodium (III) halides and rhodium complex salts having halogen, amine or oxalato ligands, such as hexachlororhodium(III) complex salt, pentachloroaquorhodium(III) complex salt, tetrachlorodiaquorhodium(III) complex salt, hexabromorhodium(III) complex salt, hexamminerhodium (III) complex salt, and trioxalatorhodium(III) complex salt. On use, these rhodium compounds are dissolved in water or suitable solvents. They are preferably added by a method commonly employed for stabilizing a solution of a rhodium compound, that is, a method of adding an aqueous solution of a hydrogen halide (e.g., hydrochloric acid, hydrobromic acid or hydrofluoric acid) or an alkali halide (e.g., KCl, NaCl, KBr or NaBr).

Instead of using the water-soluble rhodium, it is possible to add, during preparation of silver halide, separate silver halide grains previously doped with rhodium, thereby dissolving rhodium.

An appropriate amount of the rhodium compound added is $1\times10^{-8}$ to $5\times10^{-6}$ mol, especially $5\times10^{-8}$ to $1\times10^{-6}$ mol, per mol of silver halide.

The rhodium compounds may be added at an appropriate stage during preparation of silver halide emulsion grains or prior to the coating of the emulsion. Preferably, the rhodium compound is added during formation of the emulsion so that the compound is incorporated into silver halide grains.

In the practice of the invention, rhenium, ruthenium and osmium are added in the form of water-soluble complex salts as described in JP-A 2042/1988, 285941/1989, 20852/1990 and 20855/1990. Especially preferred are hexacoordinate complexes represented by the formula:

$$[ML_6]^{n-}$$

wherein M is Ru, Re or Os, L is a ligand, and letter n is equal to 0, 1, 2, 3 or 4. The counter ion is not critical although it is usually an ammonium or alkali metal ion. Preferred ligands are halide ligands, cyanide ligands, cyanate ligands, nitrosil ligands, and thionitrosil ligands.

Illustrative, non-limiting, examples of the complex used herein are given below.

$[ReCl_6]^{3-}$ $[ReBr_6]^{3-}$ $[ReCl_5(NO)]^{2-}$
$[Re(NS)Br_5]^{2-}$ $[Re(NO)(CN)_5]^{2-}$ $[Re(O)_2(CN)_4]^{3-}$
$[RuCl_6]^{3-}$ $[RuCl_4(H_2O)_2]^{-}$ $[RuCl_5(H_2O)]^{2-}$
$[RuCl_5(NO)]^{2-}$ $[RuBr_5(NS)]^{2-}$
$[Ru(CO)_3Cl_3]^{2-}$ $[Ru(CO)Cl_5]^{2-}$ $[Ru(CO)Br_5]^{2-}$
$[OsCl_6]^{3-}$ $[OsCl_5(NO)]^{2-}$ $[Os(NO)(CN)_5]^{2-}$
$[Os(NS)Br_5]^{2-}$ $[Os(O)_2(CN)_4]^{4-}$

An appropriate amount of these compounds added is $1\times10^{-9}$ to $1\times10^{-5}$ mol, especially $1\times10^{-8}$ to $1\times10^{-6}$ mol, per mol of silver halide.

These compounds may be added at an appropriate stage during preparation of silver halide emulsion grains or prior to the coating of the emulsion. Preferably, the compound is added during formation of the emulsion so that the compound is incorporated into silver halide grains.

In order that the compound be added during formation of silver halide grains so that the compound is incorporated into silver halide grains, there can be employed a method of adding a powder metal complex or an aqueous solution of a powder metal complex dissolved together with NaCl or KCl, to a water-soluble salt or water-soluble halide solution during formation of grains; a method of preparing silver halide grains by adding an aqueous solution of a metal complex as a third solution when silver salt and halide solutions are simultaneously mixed, thereby simultaneously mixing the three solutions; or a method of admitting a necessary amount of an aqueous solution of a metal complex into a reactor during formation of grains. Of these, the method of adding a powder metal complex or an aqueous solution of a powder metal complex dissolved together with NaCl or KCl to a water-soluble halide solution is especially preferred.

For addition to surfaces of grains, a necessary amount of an aqueous solution of a metal complex can be admitted into a reactor immediately after formation of grains, during or after physical ripening or during chemical ripening.

As the iridium compound, a variety of compounds may be used. Examples include hexachloroiridium, hexammineiridium, trioxalatoiridium, hexacyanoiridium, and pentachloronitrosiliridium. These iridium compounds are used by dissolving in water or suitable solvents. They are preferably added by a method commonly employed for stabilizing a solution of an iridium compound, that is, a method of adding an aqueous solution of a hydrogen halide (e.g., hydrochloric acid, hydrobromic acid or hydrofluoric acid) or an alkali halide (e.g., KCl, NaCl, KBr or NaBr). Instead of using the water-soluble iridium, it is possible to add, during preparation of silver halide, separate silver halide grains previously doped with iridium, thereby dissolving iridium.

The silver halide grains used herein may contain metal atoms such as cobalt, iron, nickel, chromium, palladium, platinum, gold, thallium, copper, and lead. Preferred compounds of cobalt, iron, chromium and ruthenium are hexacyano metal complexes. Illustrative, non-limiting, examples include ferricyanate, ferrocyanate, hexacyanocobaltate, hexacyanochromate and hexacyanoruthenate ions. The distribution of the metal complex in silver halide grains is not critical. That is, the metal complex may be contained in silver halide grains uniformly or at a high concentration in either the core or the shell.

An appropriate amount of the metal added is $1\times10^{-9}$ to $1\times10^{-4}$ mol per mol of silver halide. The metal may be contained in silver halide grains by adding a metal salt in the form of a single salt, double salt or complex salt during preparation of grains.

Photosensitive silver halide grains may be desalted by any of well-known water washing methods such as noodle and flocculation methods although silver halide grains may be either desalted or not according to the invention.

The silver halide emulsion used herein should preferably be chemically sensitized. The chemical sensitization methods which can be used herein are sulfur, selenium, tellurium, and noble metal sensitization methods which are well known in the art. These methods may be used singly or in combination. When they are used together, preferred combinations are a combination of sulfur sensitization with gold sensitization, a combination of sulfur sensitization with selenium sensitization and gold sensitization, a combination of sulfur sensitization with tellurium sensitization and gold sensitization, and a combination of sulfur sensitization with selenium sensitization, tellurium sensitization and gold sensitization.

Sulfur sensitization is generally carried out by adding a sulfur sensitizer to an emulsion and agitating the emulsion at an elevated temperature above 40° C. for a certain time. The sulfur sensitizers used herein are well-known sulfur compounds, for example, sulfur compounds contained in gelatin as well as various sulfur compounds such as thiosulfates, thioureas, thiazoles, and rhodanines. Preferred sulfur compounds are thiosulfate salts and thiourea compounds. The amount of the sulfur sensitizer added varies with chemical ripening conditions including pH, temperature and silver halide grain size although it is preferably $10^{-7}$ to $10^{-2}$ mol, more preferably $10^{-5}$ to $10^{-3}$ mol per mol of silver halide.

It is also useful to use selenium sensitizers which include well-known selenium compounds. Specifically, selenium sensitization is generally carried out by adding an unstable selenium compound and/or non-unstable selenium compound to an emulsion and agitating the emulsion at elevated temperature above 40° C. for a certain time. Preferred examples of the unstable selenium compound include those described in JP-B 15748/1969, JP-B 13489/1968, JP-A 25832/1992, JP-A 109240/1992 and JP-A 121798/1991. Especially preferred are the compounds represented by general formulae (VIII) and (IX) in JP-A 324855/1992.

The tellurium sensitizers are compounds capable of forming silver telluride, which is presumed to become sensitization nuclei, at the surface or in the interior of silver halide grains. The production rate of silver telluride in a silver halide emulsion can be determined by the test method described in JP-A 313284/1993. Exemplary tellurium sensitizers include diacyltellurides, bis(oxycarbonyl)tellurides, bis(carbamoyl)tellurides, bis(oxycarbonyl)ditellurides, bis (carbamoyl)ditellurides, compounds having a P═Te bond, tellurocarboxylic salts, Te-organyltellurocarboxylic esters, di(poly)tellurides, tellurides, telluroles, telluroacetals, tellurosulfonates, compounds having a P—Te bond, Te-containing heterocycles, tellurocarbonyl compounds, inorganic tellurium compounds, and colloidal tellurium. Examples are described in U.S. Pat. Nos. 1,623,499, 3,320,069, 3,772,031, BP 235,211, 1,121,496, 1,295,462, 1,396,696, Canadian Patent No. 800,958, JP-A 204640/1992, Japanese Patent Application Nos. 53693/1991, 30 131598/1991, 129787/1992, J. Chem. Soc. Chem. Commun., 635 (1980), ibid., 1102 (1979), ibid., 645 (1979), J. Chem. Soc. Perkin. Trans., 1, 2191 (1980), S. Patai Ed., The Chemistry of Organic Selenium and Tellurium Compounds, Vol. 1 (1986), ibid., Vol. 2 (1987). Especially preferred are the compounds represented by general formulae (II), (III) and (IV) in JP-A 313284/1993.

The amounts of the selenium and tellurium sensitizers used vary with the type of silver halide grains, chemical ripening conditions and other factors although they are preferably about $10^{-8}$ to $10^{-2}$ mol, more preferably about $10^{-7}$ to $10^{-3}$ mol per mol of silver halide. The chemical sensitizing conditions are not particularly limited although preferred conditions include a pH of 5 to 8, a pAg of 6 to 11, more preferably 7 to 10, and a temperature of 40 to 95° C., more preferably 45 to 85° C.

Useful as the noble metal sensitizers are compounds of gold, platinum, palladium, and iridium, with gold sensitization being especially preferred. Examples of the gold sensitizer include chloroauric acid, potassium chloroaurate, potassium aurithiocyanate, and gold sulfide. An appropriate amount of the gold sensitizer is about $10^{-7}$ to $10^{-2}$ mol per mol of silver halide.

In the preparation of the silver halide emulsion used herein, any of cadmium salts, sulfite salts, lead salts, and thallium salts may be co-present in the silver halide grain forming step or physical ripening step.

Reduction sensitization may also be used in the practice of the invention. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

To the silver halide emulsion according to the invention, thiosulfonic acid compounds may be added by the method described in EP-A 293,917.

The silver halide emulsion in the photothermographic element according to the invention may be a single emulsion or a mixture of two or more emulsions which are different in mean grain size, halogen composition, crystal habit or chemical sensitizing conditions.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

Reducing Agent

The photothermographic element of the invention contains a reducing agent for the organic silver salt. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol %, more preferably 10 to 40 mol % per mol of silver on the image forming layer-bearing side. The reducing agent may be added to any layer on the image forming layer-bearing side. Where the reducing agent is added to a layer other than the image forming layer, the reducing agent should preferably be contained in a slightly greater amount of about 10 to 50 mol % per mol of silver. The reducing agent may take the form of a precursor which is modified so as to exert its effective function only at the time of development.

For photothermographic elements using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2 -phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Described below are various chemical addenda that can be used in the photothermographic element of the invention.

Contrast Enhancer

Contrast enhancers which can be used herein are substituted alkene derivatives, substituted isoxazole derivatives, and specific acetal compounds of the following formulas (3), (4), and (5), respectively.

(3)

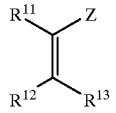

In formula (3), $R^{11}$, $R^{12}$, and $R^{13}$ are independently hydrogen or monovalent substituents, and Z is an electron attractive group or silyl group. $R^{11}$ and Z, $R^{12}$ and $R^{13}$, $R^{11}$ and $R^{12}$, or $R^{13}$ and Z, taken together, may form a cyclic structure.

(4)

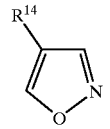

In formula (4), $R^{14}$ is a monovalent substituent.

(5)

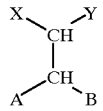

In formula (5), X and Y are independently hydrogen or monovalent substituents, A and B are independently alkoxy, alkylthio, alkylamino, aryloxy, arylthio, anilino, heterocyclic oxy, heterocyclic thio, or heterocyclic amino groups. X and Y, or A and B, taken together, may form a cyclic structure.

First, the substituted alkene derivatives of formula (3) are described in detail. In formula (3), $R^{11}$, $R^{12}$, and $R^{13}$ are independently hydrogen or monovalent substituents, and Z is an electron attractive group or silyl group. $R^{11}$ and Z, $R^{12}$ and $R^{13}$, $R^{11}$ and $R^{12}$, or $R^{13}$ and Z, taken together, may form a cyclic structure.

When $R^{11}$, $R^{12}$, and $R^{13}$ represent substituents, exemplary substituents include halogen atoms (e.g., fluorine, chlorine, bromine and iodine atoms), alkyl groups (including aralkyl, cycloalkyl and active methine groups), alkenyl groups, alkynyl groups, aryl groups, heterocyclic groups (inclusive of N-substituted nitrogenous heterocyclic groups), quaternized nitrogen atom-containing heterocyclic groups (such as pyridinio), acyl groups, alkoxycarbonyl groups, aryloxycarbonyl groups, carbamoyl groups, carboxy groups or salts thereof, imino groups, N-substituted imino groups, thiocarbonyl groups, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups or salts thereof, alkoxy groups (including groups containing recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic)amino groups, acylamino groups, sulfonamide groups, ureido groups, thioureido groups, imide groups, (alkoxy or aryloxy)carbonylamino groups, sulfamoylamino groups, semicarbazide groups, thiosemicarbazide groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic)thio groups, acylthio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, phosphoryl groups, phosphoramide or phosphate structure-bearing groups, silyl groups, and stannyl groups. These substituents may be further replaced by other substituents selected from the foregoing examples.

In formula (3), Z is an electron attractive group or silyl group. The electron attractive group is a substituent whose Hammett substituent constant $\sigma p$ has a positive value. Exemplary electron attractive groups are cyano groups, alkoxycarbonyl groups, aryloxycarbonyl groups, carbamoyl groups, imino groups, N-substituted imino groups, thiocarbonyl groups, sulfamoyl groups, alkylsulfonyl groups, arylsulfonyl groups, nitro groups, halogen atoms, perfluoroalkyl groups, perfluoroalkaneamide groups, sulfonamide groups, acyl groups, formyl groups, phosphoryl groups, carboxy groups (or salts thereof), sulfo groups (or salts thereof), heterocyclic groups, alkenyl groups, alkynyl groups, acyloxy groups, acylthio groups, sulfonyloxy groups, and aryl groups having such electron attractive groups substituted thereon. The heterocyclic groups include saturated or unsaturated heterocyclic groups, for example, pyridyl, quinolyl, pyrazinyl, quinoxalinyl, benzotriazolyl, imidazolyl, benzimidazolyl, hydantoin-1-yl, succinimide and phthalimide groups.

The electron attractive group represented by Z in formula (3) may have a substituent or substituents which are selected from the same substituents that the substituents represented by $R^{11}$, $R^{12}$ and $R^{13}$ in formula (3) may have.

In formula (3), $R^{11}$ and Z, $R^{12}$ and $R^{13}$, $R^{11}$ and $R^{12}$, or $R^{13}$ and Z, taken together, may form a cyclic structure, which is a non-aromatic carbocyclic or non-aromatic heterocyclic one.

Described below is the preferred range of the compounds of formula (3). Preferred examples of the silyl group represented by Z in formula (3) include trimethylsilyl, t-butyldimethylsilyl, phenyldimethylsilyl, triethylsilyl, triisopropylsilyl, and trimethylsilyldimethylsilyl groups.

Preferred examples of the electron attractive group represented by Z in formula (3) include groups having 0 to 30 carbon atoms in total, for example, cyano, alkoxycarbonyl, aryloxycarbonyl, carbamoyl, thiocarbonyl, imino, N-substituted imino, sulfamoyl, alkylsulfonyl, arylsulfonyl, nitro, perfluoroalkyl, acyl, formyl, phosphoryl, acyloxy, and acylthio groups, and phenyl groups having an electron attractive group substituted thereon. More preferred examples include cyano, alkoxycarbonyl, carbamoyl, imino, sulfamoyl, alkylsulfonyl, arylsulfonyl, acyl, formyl, phosphoryl, and trifluoromethyl groups, and phenyl groups having an electron attractive group substituted thereon. Further preferred examples include cyano, formyl, acyl, alkoxycarbonyl, imino and carbamoyl groups.

The preferred groups represented by Z in formula (3) are electron attractive groups.

The substituents represented by $R^{11}$, $R^{12}$ and $R^{13}$ in formula (3) are preferably groups having 0 to 30 carbon atoms in total, for example, the same groups as the electron attractive groups represented by Z in formula (3), as well as alkyl, hydroxy (or salts thereof), mercapto (or salts thereof), alkoxy, aryloxy, heterocyclic oxy, alkylthio, arylthio, heterocyclic thio, amino, alkylamino, arylamino, heterocyclic amino, ureido, acylamino, sulfonamide, and substituted or unsubstituted aryl groups.

In formula (3), $R^{11}$ is preferably an electron attractive group, aryl group, alkylthio group, alkoxy group, acylamino group, hydrogen atom or silyl group.

When $R^{11}$ represents electron attractive groups, they are preferably groups of 0 to 30 carbon atoms, including cyano, nitro, acyl, formyl, alkoxycarbonyl, aryloxycarbonyl, thiocarbonyl, imino, N-substituted imino, alkylsulfonyl, arylsulfonyl, carbamoyl, sulfamoyl, trifluoromethyl, phosphoryl, carboxy (or salts thereof), and saturated or unsaturated heterocyclic groups; more preferably cyano, acyl, formyl, alkoxycarbonyl, carbamoyl, imino, N-substituted imino, sulfamoyl, carboxy (or salts thereof), and saturated or unsaturated heterocyclic groups; most preferably cyano, formyl, acyl, alkoxycarbonyl, carbamoyl, and saturated or unsaturated heterocyclic groups.

When $R^{11}$ represents aryl groups, they are preferably substituted or unsubstituted phenyl groups having 6 to 20 carbon atoms in total wherein the substituents, if any, are arbitrary although electron attractive substituents are preferred.

More preferably, $R^{11}$ in formula (3) is an electron attractive group or aryl group.

The substituents represented by $R^{12}$ and $R^{13}$ in formula (3) are preferably the same groups as the electron attractive groups represented by Z in formula (3), as well as alkyl, hydroxy (or salts thereof), mercapto (or salts thereof), alkoxy, aryloxy, heterocyclic oxy, alkylthio, arylthio, heterocyclic thio, amino, alkylamino, anilino, heterocyclic amino, acylamino, and substituted or unsubstituted phenyl groups.

More preferably, one of $R^{12}$ and $R^{13}$ in formula (3) is hydrogen and the other is a substituent. In this case, preferred substituents are alkyl, hydroxy (or salts thereof), mercapto (or salts thereof), alkoxy, aryloxy, heterocyclic oxy, alkylthio, arylthio, heterocyclic thio, amino, alkylamino, anilino, heterocyclic amino, acylamino (especially perfluoroalkaneamide), sulfonamide, substituted or unsubstituted phenyl and heterocyclic groups; more preferably hydroxy (or salts thereof), mercapto (or salts thereof), alkoxy, aryloxy, heterocyclic oxy, alkylthio, arylthio, heterocyclic thio and heterocyclic groups; and most preferably hydroxy (or salts thereof), alkoxy or heterocyclic groups.

It is also preferred that Z and $R^{11}$, or $R^{12}$ and $R^{13}$ in formula (3) form a cyclic structure together. The cyclic structures formed are non-aromatic carbocyclic or non-aromatic heterocyclic structures, preferably 5- to 7-membered cyclic structures having 1 to 40 carbon atoms, more preferably 3 to 30 carbon atoms in total inclusive of the carbon atoms in substituents.

Especially preferred of the compounds of formula (3) are those wherein Z is a cyano, formyl, acyl, alkoxycarbonyl, imino or carbamoyl group, $R^{11}$ is an electron withdrawing group or aryl group, one of $R^{12}$ and $R^{13}$ is hydrogen and the other is a hydroxy (or salts thereof), mercapto (or salts thereof), alkoxy, aryloxy, heterocyclic oxy, alkylthio, arylthio, heterocyclic thio or heterocyclic group.

Also especially preferred of the compounds of formula (3) are those wherein Z and $R^{11}$ form a non-aromatic, 5- to 7-membered cyclic structure together, one of $R^{12}$ and $R^{13}$ is hydrogen and the other is a hydroxy (or salts thereof), mercapto (or salts thereof), alkoxy, aryloxy, heterocyclic oxy, alkylthio, arylthio, heterocyclic thio or heterocyclic group. In this case, Z which forms a non-aromatic cyclic structure with $R^{11}$ is preferably an acyl, carbamoyl, oxycarbonyl, thiocarbonyl or sulfonyl group while $R^{11}$ is preferably an acyl, carbamoyl, oxycarbonyl, thiocarbonyl, sulfonyl, imino, N-substituted imino, acylamino or carbonylthio group.

Secondly, the substituted isoxazole derivatives of formula (4) are described in detail. In formula (4), $R^{14}$ is a substituent. The definition and examples of the substituent represented by $R^{14}$ are the same as described for the substituents represented by $R^{11}$ to $R^{13}$ in formula (3).

In formula (4), the substituents represented by $R^{14}$ are preferably electron attractive groups or aryl groups. Preferred examples of the electron attractive groups include groups having 0 to 30 carbon atoms in total, such as cyano, nitro, acyl, formyl, alkoxycarbonyl, aryloxycarbonyl, alkylsulfonyl, arylsulfonyl, carbamoyl, sulfamoyl, trifluoromethyl, phosphoryl, imino, and saturated or unsaturated heterocyclic groups; more preferably cyano, acyl, formyl, alkoxycarbonyl, carbamoyl, sulfamoyl, alkylsulfonyl, arylsulfonyl, and heterocyclic groups; most preferably cyano, formyl, acyl, alkoxycarbonyl, carbamoyl, and heterocyclic groups.

When $R^{14}$ represents aryl, preferred aryl groups are substituted or unsubstituted phenyl groups having 6 to 30 carbon atoms in total. The substituents on the aryl groups are the same as described for the substituents represented by $R^{11}$ to $R^{13}$ in formula (3).

Preferably in formula (4), $R^{14}$ represents cyano, alkoxycarbonyl, carbamoyl, heterocyclic, or substituted or unsubstituted phenyl groups, and especially cyano, heterocyclic or alkoxycarbonyl groups.

Thirdly, the acetal compounds of formula (5) are described in detail. In formula (5), X and Y are independently hydrogen or substituents, A and B are independently alkoxy, alkylthio, alkylamino, aryloxy, arylthio, anilino, heterocyclic thio, heterocyclic oxy, or heterocyclic amino groups. X and Y, or A and B, taken together, may form a cyclic structure.

The substituents represented by X and Y are the same as described for the substituents represented by $R^{11}$ to $R^{13}$ in formula (3). Exemplary substituents are alkyl (inclusive of perfluoroalkyl and trichloromethyl), aryl, heterocyclic, halogen, cyano, nitro, alkenyl, alkynyl, acyl, formyl, alkoxycarbonyl, aryloxycarbonyl, imino, N-substituted imino, carbamoyl, thiocarbonyl, acyloxy, acylthio, acylamino, alkylsulfonyl, arylsulfonyl, sulfamoyl, phosphoryl, carboxy (or salts thereof), sulfo (or salts thereof), hydroxy (or salts thereof), mercapto (or salts thereof), alkoxy, aryloxy, heterocyclic oxy, alkylthio, arylthio, heterocyclic thio, amino, alkylamino, anilino, heterocyclic amino, and silyl groups. These groups may further have substituents. X and Y may bond together to form a cyclic structure, which may be either a non-aromatic carbocyclic or non-aromatic heterocyclic ring.

In formula (5), the groups represented by X and Y are preferably groups having 1 to 40 carbon atoms in total, more preferably 1 to 30 carbon atoms in total, and include cyano, alkoxycarbonyl, aryloxycarbonyl, carbamoyl, imino, N-substituted imino, thiocarbonyl, sulfamoyl, alkylsulfonyl, arylsulfonyl, nitro, perfluoroalkyl, acyl, formyl, phosphoryl, acylamino, acyloxy, acylthio, heterocyclic, alkylthio, alkoxy, and aryl groups.

In formula (5), more preferred substituents represented by X and Y are cyano, nitro, alkoxycarbonyl, carbamoyl, acyl, formyl, acylthio, acylamino, thiocarbonyl, sulfamoyl, alkylsulfonyl, arylsulfonyl, imino, N-substituted imino, phosphoryl, trifluoromethyl, heterocyclic, and substituted phenyl groups. Especially preferred are cyano, alkoxycarbonyl, carbamoyl, alkylsulfonyl, arylsulfonyl, acyl, acylthio, acylamino, thiocarbonyl, formyl, imino, N-substituted imino, heterocyclic groups and phenyl groups having an electron attractive group substituted thereon.

It is also preferred that X and Y bond together to form a non-aromatic carbocyclic or non-aromatic heterocyclic ring. In this case, the cyclic structures are preferably 5- to 7-membered rings and have 1 to 40 carbon atoms, especially 3 to 30 carbon atoms in total. X and Y forming a cyclic structure are preferably acyl, carbamoyl, oxycarbonyl, thiocarbonyl, sulfonyl, imino, N-substituted imino, acylamino, and carbonylthio groups.

In formula (5), A and B are independently alkoxy, alkylthio, alkylamino, aryloxy, arylthio, anilino, heterocyclic thio, heterocyclic oxy or heterocyclic amino groups. A and B, taken together, may form a ring.

The groups represented by A and B in formula (5) are preferably groups having 1 to 40 carbon atoms in total, more preferably 1 to 30 carbon atoms in total, and may further have substituents.

It is more preferred in formula (5) that A and B bond together to form a ring. In this case, the cyclic structures are preferably 5- to 7-membered non-aromatic heterocycles and have 1 to 40 carbon atoms, especially 3 to 30 carbon atoms in total. Examples of A bonded to B (that is, —A—B—) include $—O—(CH_2)_2—O—$, $—O—(CH_2)_3—$, $—S—(CH_2)_2—S—$, $—S—(CH_2)_3—S—$, —S—Ph—S—, $—N(CH_3)—(CH_2)_2—O—$, $—N(CH_3)—(CH_2)_2—S—$, $—O—(CH_2)_2—S—$, $—O—(CH_2)_3—S—$, $—N(CH_3)—Ph—O—$, $—N(CH_3)—Ph—S—$, and $—N(Ph)—(CH_2)_2—S—$.

The compounds of formulas (3), (4), and (5) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

The compounds of formulas (3), (4), and (5) may have incorporated therein a ballast group or polymer commonly used in immobile photographic additives such as couplers. The incorporation of a ballast group is one of the preferred embodiments of the present invention. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

The compounds of formulas (3), (4), and (5) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). The incorporation of groups containing recurring ethylenoxy or propylenoxy units or (alkyl, aryl or heterocyclic) thio groups is one of the preferred embodiments of the present invention. Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

Illustrative examples of the compounds of formulas (3), (4), and (5) are given below although the invention is not limited thereto.

C-1

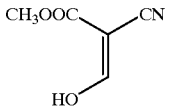

C-2

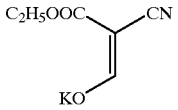

C-3

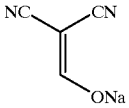

C-4

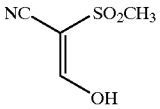

C-5

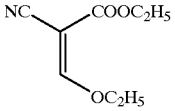

C-6

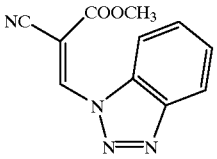

C-7

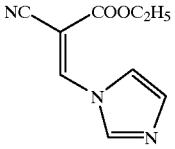

C-8

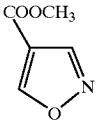

-continued

C-9

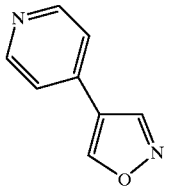

C-10

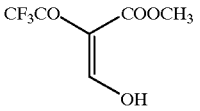

C-11

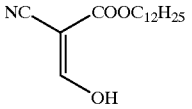

C-12

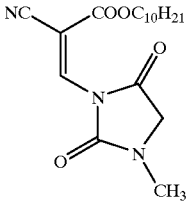

C-13

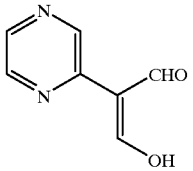

C-14

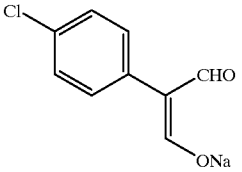

C-15

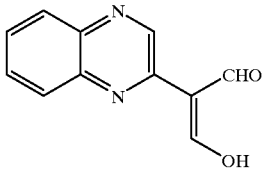

C-16

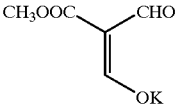

C-17

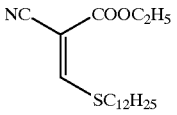

-continued
C-18
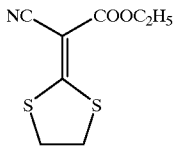
C-19
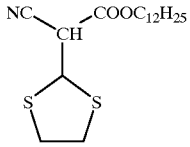
C-20
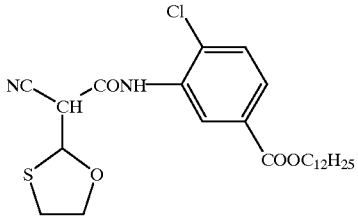
C-21
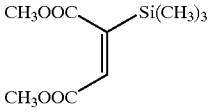
C-22
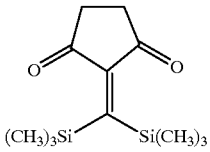
C-23
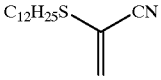
C-24
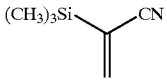
C-25
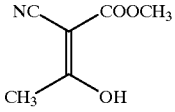
C-26
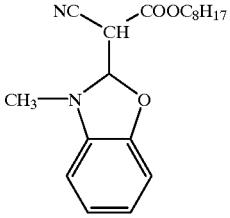
-continued
C-27
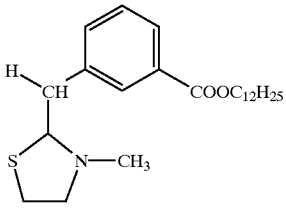
C-28
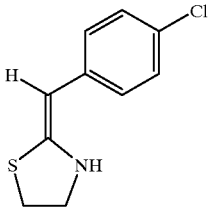
C-29
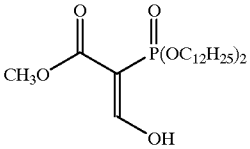
C-30
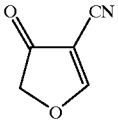
C-31
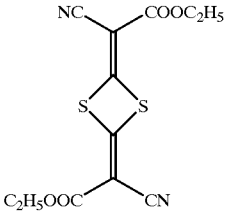
C-32
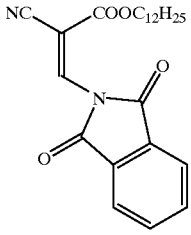
C-33
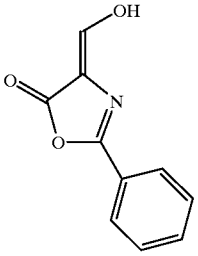

-continued
C-34
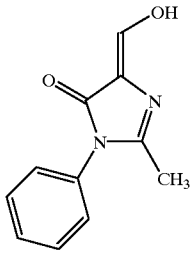
C-35
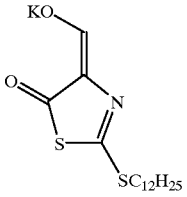
C-36
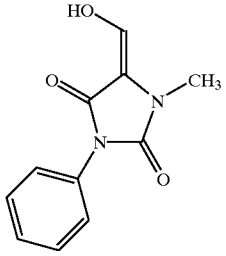
C-37
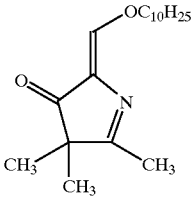
C-38
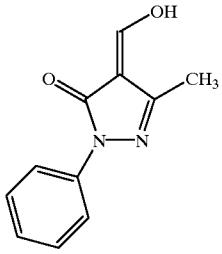
C-39
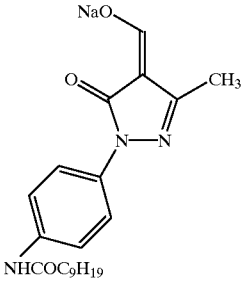
-continued
C-40
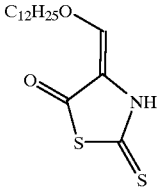
C-41
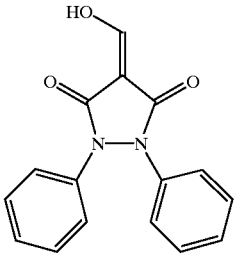
C-42
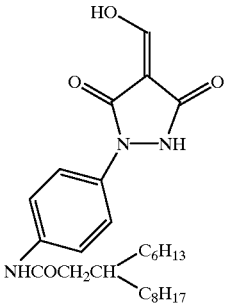
C-43
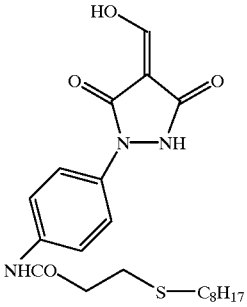
C-44
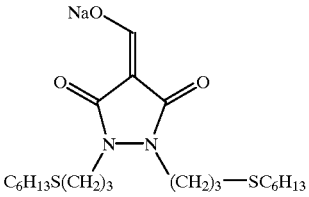

-continued
C-45
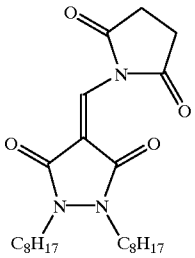
C-46
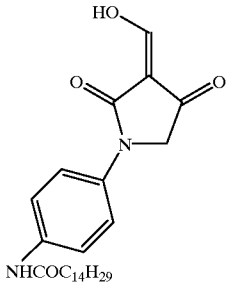
C-47
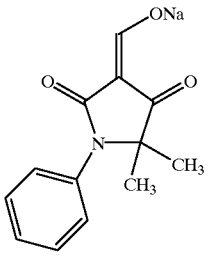
C-48
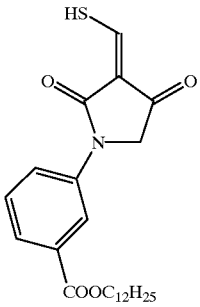
C-49
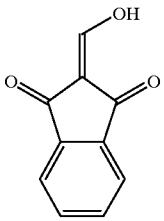
-continued
C-50
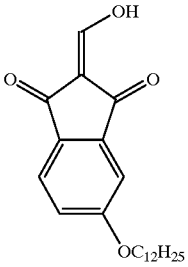
C-51
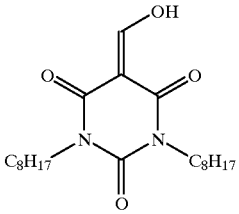
C-52
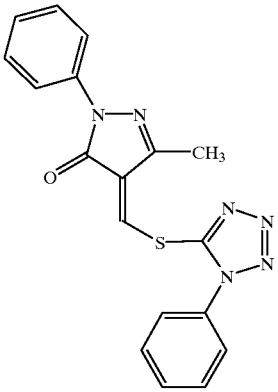
C-53
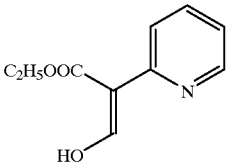
C-54
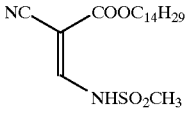
C-55
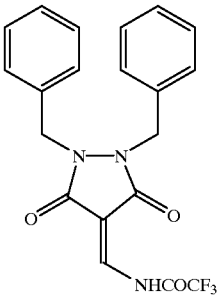

-continued

C-56

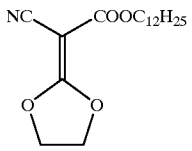

C-57

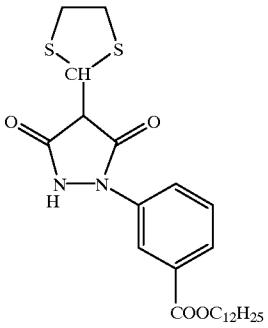

C-58

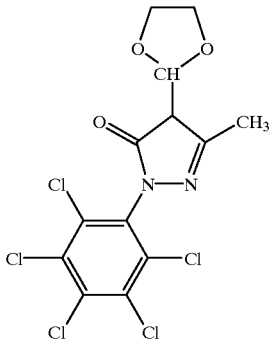

C-59

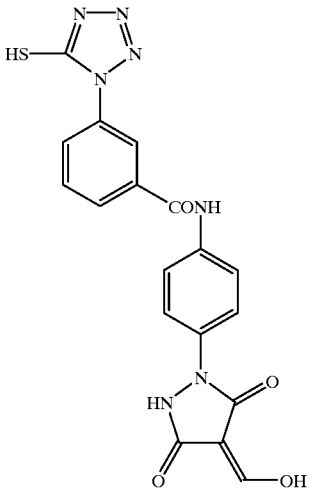

C-60

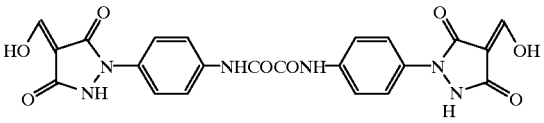

The compounds of formulas (3), (4), and (5) can be readily synthesized by well-known methods, for example, the methods described in U.S. Pat. Nos. 5,545,515, 5,635,339, and 5,654,130, WO 97/34196, and Japanese Patent Application Nos. 354107/1997, 309813/1997, and 272002/1997.

In the practice of the invention, the compound of formula (3) to (5) is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

A well-known emulsifying dispersion method may be used for dissolving the compound of formula (3) to (5) with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the compound of formula (3) to (5) in powder form in a suitable solvent, typically water, in a ball mill, colloidal mill or ultrasonic mixer.

The compound of formula (3) to (5) may be added to a layer on the photosensitive layer-bearing side of the support, that is, a photosensitive layer or any other layer on that side of the support, and preferably to the photosensitive layer or a layer disposed adjacent thereto.

The compound of formula (3) to (5) is preferably used in an amount of $1\times10^{-6}$ mol to 1 mol, more preferably $1\times10^{-5}$ mol to $5\times10^{-1}$ mol, and most preferably $2\times10^{-5}$ mol to $2\times10^{-1}$ mol per mol of silver.

The compounds of formulas (3) to (5) may be used alone or in admixture of two or more. In combination with the compounds of formulas (3) to (5), there may be used any of the compounds described in U.S. Pat. Nos. 5,545,515, 5,635,339, 5,654,130, and 5,686,228, WO 97/34196, and Japanese Patent Application Nos. 279962/1996, 228881/1997, 273935/1997, 354107/1997, 309813/1997, 296174/1997, 282564/1997, 272002/1997, 272003/1997, and 332388/1997.

In the practice of the invention, any of the hydrazine derivatives described in Japanese Patent Application Nos. 166628/1997, 279957/1996, and 240511/1997 may be used in combination. Furthermore, any of the following hydrazine derivatives may be used in combination. Exemplary hydrazine derivatives which can be used herein include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulae (A), (B), (C), (D), (E), and (F), more specifically compounds N-1 to N-30 described therein; and the compounds of the general formula (1) in EP 713131A, more specifically compounds D-1 to D-55 described therein.

Also useful are the hydrazine derivatives described in "Known Technology," Aztech K.K., Mar. 22, 1991, pages 25–34 and Compounds D-2 and D-39 described in JP-A 86354/1987, pages 6–7.

In the practice of the invention, the hydrazine derivative is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

A well-known emulsifying dispersion method may be used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine derivative may be added to a layer on the photosensitive layer-bearing side of the support, that is, a photosensitive layer or any other layer on that side of the support, and preferably to the photosensitive layer or a layer disposed adjacent thereto.

The hydrazine derivative is preferably used in an amount of $1\times10^{-6}$ mol to 1 mol, more preferably $1\times10^{-5}$ mol to $5\times10^{-1}$ mol, and most preferably $2\times10^{-5}$ mol to $2\times10^{-1}$ mol per mol of silver.

Also in the practice of the invention, contrast promoting agents may be used in combination with the aforementioned contrast enhancers for forming high contrast images. Such ultrahigh contrast promoting agents include the amine compounds described in U.S. Pat. No. 5,545,505, specifically Compounds AM-1 to AM-5 therein, the hydroxamic acids described in U.S. Pat. No. 5,545,507, specifically HA-1 to HA-11 therein, the acrylonitriles described in U.S. Pat. No. 5,545,507, specifically CN-1 to CN-13 therein, the hydrazine compounds described in U.S. Pat. No. 5,558,983, specifically CA-1 to CA-6 therein, the onium salts described in Japanese Patent Application No. 132836/1996, specifically A-1 to A-42, B-1 to B-27 and C-1 to C-14.

The synthesis methods, addition methods, and addition amounts of these contrast enhancers and contrast promoting agents are as described in the above-listed patents.

Sensitizing Dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in *Research Disclosure*, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and process cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He—Ne lasers, red laser diodes, and LED.

For compliance with laser diode light sources in the wavelength range of 750 to 1,400 nm, it is advantageous to spectrally sensitize silver halide grains. Such spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole or imidazole nucleus. Preferred examples of the useful merocyanine dye contain an acidic nucleus such as a thiohydantoin, rhodanine, oxazolidinedione, thiazolinedione, barbituric acid, thiazolinone, malononitrile or pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in *Research Disclosure*, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

Toner

Better results are sometimes obtained when an additive known as a "toner" for improving images is contained. The toner is preferably used in an amount of 0.1 to 10% by weight of the overall silver-carrying components. The toners are well known in the photographic art as described in U.S. Pat. Nos. 3,080,254, 3,847,612 and 4,123,282.

Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexammine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl)phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 4-(1-naphthyl)phthalazine, 6-chlorophthalazine, 5,7-dimethoxyphthalazine and 2,3-dihydrophthalazine; combinations of phthalazine with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129845/1987, 208191/1994, 5621/1995, 2781/1995, 15809/1996, U.S. Pat. Nos. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of $10^{-9}$ mol to $10^{-3}$ mol, more preferably $10^{-8}$ mol to $10^{-4}$ mol per mol of silver coated.

Still further, the photothermographic element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the photothermographic element, preferably to a layer on the same side as the photosensitive layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably $10^{-6}$ to 2 mol, more preferably $10^{-3}$ to 0.5 mol per mol of silver.

In the element of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M' and Ar—S—S—Ar wherein M' is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms), and aryl groups (optionally substituted). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4 -amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, and 2-mercapto-4-phenyloxazole.

These mercapto compounds are preferably added to the emulsion layer (or photosensitive layer) in amounts of 0.0001 to 1.0 mol, more preferably 0.001 to 0.3 mol per mol of silver.

In the photosensitive layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in BP 955,061 may be added as a plasticizer and lubricant.

The photosensitive layer used herein is usually based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene, and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

At least one layer of the photosensitive layers used herein may be a photosensitive layer wherein a polymer latex as defined previously constitutes at least 50% by weight of the entire binder.

Protective Layer

A surface protective layer may be provided in the photothermographic element of the present invention for the purpose of preventing sticking of the photosensitive layer.

The surface protective layer is based on a binder which may be any desired polymer, although the layer preferably contains 100 mg/m$^2$ to 5 g/m$^2$ of a polymer having a carboxylic acid residue. The polymers having a carboxylic acid residue include natural polymers (e.g., gelatin and alginic acid), modified natural polymers (e.g., carboxymethyl cellulose and phthalated gelatin), and synthetic polymers (e.g., polymethacrylate, polyacrylate, polyalkyl methacrylate/acrylate copolymers, and polystyrene/polymethacrylate copolymers). The content of the carboxylic acid residue is preferably 10 mmol to 1.4 mol per 100 grams of the polymer. The carboxylic acid residue may form a salt with an alkali metal ion, alkaline earth metal ion or organic cation.

In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof. Crosslinking agents for crosslinking, surfactants for ease of application, and other addenda are optionally added to the surface protective layer.

In the photosensitive layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699. The filer dyes are used in such amounts that the layer may have an absorbance of 0.1 to 3, especially 0.2 to 1.5 at the exposure wavelength.

In the photosensitive layer, a variety of dyes and pigments may be used from the standpoints of improving tone and preventing irradiation. Any desired dyes and pigments may be used in the invention. Useful pigments and dyes include those described in Colour Index and both organic and inorganic, for example, pyrazoloazole dyes, anthraquinone dyes, azo dyes, azomethine dyes, oxonol dyes, carbocyanine dyes, styryl dyes, triphenylmethane dyes, indoaniline dyes, indophenol dyes, and phthalocyanine dyes. The preferred dyes used herein include anthraquinone dyes (e.g., Compounds 1 to 9 described in JP-A 341441/1993 and Compounds 3-6 to 3-18 and 3-23 to 3-38 described in JP-A 165147/1993), azomethine dyes (e.g., Compounds 17 to 47 described in JP-A 341441/1993), indoaniline dyes (e.g., Compounds 11 to 19 described in JP-A 289227/1993, Compound 47 described in JP-A 341441/1993 and Compounds 2-10 to 2-11 described in JP-A 165147/1993), and azo dyes (e.g., Compounds 10 to 16 described in JP-A 341441/1993). The dyes and pigments may be added in any desired form such as solution, emulsion or solid particle dispersion or in a form mordanted with polymeric mordants. The amounts of these compounds used are determined in accordance with the desired absorption although the compounds are generally used in amounts of 1 $\mu$g to 1 g per square meter of the element.

In one preferred embodiment, the photothermographic element of the invention is a one-side photothermographic element having at least one photosensitive layer containing a silver halide emulsion on one side and a back layer on the other side of the support.

Where an anti-halation dye is used in the invention, it may be selected from various compounds insofar as it has the desired absorption in the wavelength range, is sufficiently low absorptive in the visible region after processing, and provides the back layer with the preferred absorbance profile. Exemplary antihalation dyes are given below though the dyes are not limited thereto. Useful dyes which are used alone are described in JP-A 56458/1984, 216140/1990, 13295/1995, 11432/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column. It is further preferable in the practice of the invention to use a dye which will decolorize during processing. Illustrative, non-limiting, examples of decolorizable dyes are disclosed in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896, and 5,187,049.

In the practice of the invention, the binder used in the layers of the back layer other than the outermost back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

In the one-side photothermographic element of the invention, a matter agent may be added to a layer on the photosensitive emulsion layer side, for example, a surface protective layer for improving transportation. Use may be made of the same class of matte agents as the aforementioned matte agents which can be added to the back layer or a surface protective layer therefor. In one preferred embodiment, the matte agent is added to the back layer. The back layer should preferably have a degree of matte as expressed by a Bekk smoothness of 1 to 2,000 seconds, more preferably 10 to 1,000 seconds.

In the photothermographic element of the invention, the matte agent is preferably contained in an outermost surface layer, a layer functioning as an outermost surface layer, a layer close to the outer surface or a layer functioning as a so-called protective layer. The emulsion layer side protective layer may have any degree of matte insofar as no star dust failures occur although a Bekk smoothness of 500 to 10,000 seconds, especially 500 to 2,000 seconds is preferred.

The photothermographic emulsion used in the photothermographic element according to the invention is contained in one or more layers on a support. In the event of single layer construction, it should contain an organic silver salt, silver halide, developing agent, and binder, and other optional additives such as a toner, coating aid and other auxiliary agents. In the event of two-layer construction, a first emulsion layer which is generally a layer disposed adjacent to the support should contain an organic silver salt and silver halide and a second emulsion layer or both the layers contain other components. Also envisioned herein is a two-layer construction consisting of a single emulsion layer containing all the components and a protective topcoat. In the case of multi-color sensitive photothermographic element, a combination of such two layers may be employed for each color. Also a single layer may contain all necessary components as described in U.S. Pat. No. 4,708,928. In the case of multi-dye, multi-color sensitive photothermographic element, emulsion (or photosensitive) layers are distinctly supported by providing a functional or non-functional barrier layer therebetween as described in U.S. Pat. No. 4,460,681.

A backside resistive heating layer as described in U.S. Pat. Nos. 4,460,681 and 4,374,921 may be used in a photographic thermographic image recording system according to the present invention.

According to the invention, a hardener may be used in various layers including a photosensitive layer, protective layer, and back layer as partially described above. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

A surfactant may be used for the purposes of improving coating and electric charging properties as partially described above. The surfactants used herein may be nonionic, anionic, cationic and fluorinated ones. Examples include fluorinated polymer surfactants as described in JP-A 170950/1987 and U.S. Pat. No. 5,380,644, fluorochemical surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Support

According to the invention, the thermographic emulsion may be coated on a variety of supports. Typical supports include polyester film, subbed polyester film, poly(ethylene terephthalate) film, polyethylene naphthalate film, cellulose nitrate film, cellulose ester film, poly(vinyl acetal) film, polycarbonate film and related or resinous materials, as well as glass, paper, metals, etc. Often used are flexible substrates, typically paper supports, specifically baryta paper and paper supports coated with partially acetylated α-olefin polymers, especially polymers of α-olefins having 2 to 10 carbon atoms such as polyethylene, polypropylene, and ethylene-butene copolymers. The supports are either transparent or opaque, preferably transparent. Of these, biaxially oriented polyethylene terephthalate (PET) films of about 75 to 200 μm thick are preferred.

When plastic film is passed through a thermographic processor where it will encounter a temperature of at least 80° C., the film experiences dimensional shrinkage or expansion. When the thermographic element as processed is intended for printing plate purposes, this dimensional shrinkage or expansion gives rise to a serious problem against precision multi-color printing. Therefore, the invention favors the use of a film experiencing a minimal dimensional change, that is, a film which has been biaxially stretched and then properly treated for mitigating the internal distortion left after stretching and for preventing distortion from being generated by thermal shrinkage during subsequent heat development. One exemplary material is polyethylene terephthalate (PET) film which has been heat treated at 100 to 210° C. prior to the coating of a photothermographic emulsion. Also useful are materials having a high glass transition temperature (Tg), for example, polyether ethyl ketone, polystyrene, polysulfone, polyether sulfone, polyarylate, and polycarbonate.

For antistatic purpose, the photothermographic element of the invention may be provided with a layer containing soluble salts (e.g., chlorides and nitrates), an evaporated metal layer, or a layer containing ionic polymers as described in U.S. Pat. Nos. 2,861,056 and 3,206,312, insoluble inorganic salts as described in U.S. Pat. No. 3,428,451, or tin oxide microparticulates as described in JP-A 252349/1985 and 104931/1982.

A method for producing color images using the photothermographic element of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In the practice of the invention, the photothermographic emulsion can be applied by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and BP 837,095.

In the photothermographic element of the invention, there may be contained additional layers, for example, a dye accepting layer for accepting a mobile dye image, an opacifying layer when reflection printing is desired, a protective topcoat layer, and a primer layer well known in the photothermographic art. The photothermographic element of the invention is preferably such that only a single sheet of the photothermographic element can form an image. That is, it is preferred that a functional layer necessary to form an image such as an image receiving layer does not constitute a separate member.

EXAMPLE

Examples of the invention are given below by way of illustration and not by way of limitation.

First, the supports used in Examples are described.

Preparation of Support

Preparation of back-coated sample (BC-A) A coating solution A was prepared by adding the following ingredients to a water dispersed latex.

| | |
|---|---|
| Styrene/butadiene copolymer latex (styrene:butadiene = 67:30, solids 40 wt%) | 158 g |
| Sodium salt of 2,4-dichloro-6-hydroxy-s-triazine | 0.26 g |
| Distilled water | 841.7 g |

The coating solution A was applied to one surface (or back surface) of a PET film of 120 μm thick and dried at 180° C. for 30 seconds, forming a first layer of 0.3 μm thick.

A coating solution B was prepared by mixing the following ingredients.

| | |
|---|---|
| Gelatin | 15 g |
| Compound C | 0.4 g |
| Acetic acid (20%) | 10 g |
| Dye A | 1.23 g |
| Methyl cellulose (2% aqueous solution) | 23.3 g |
| Distilled water | 950 g |

The coating solution B was applied onto the first layer and dried at 170° C. for 30 seconds, forming a second layer. The dye concentration was adjusted to give an absorbance of 0.8 at 780 nm.

The coating solution C was prepared by mixing the following ingredients.

| | |
|---|---|
| Jurimer ET410 (20% water dispersion) (acrylic resin water dispersion, Nippon Junyaku K.K.) | 19.1 g |
| FS-10D (17% water dispersion) (Sb-doped $SnO_2$ water dispersion, acicular particles, length/breadth 20–30, length 0.2–2.0 μm, breadth 0.01–0.02 μm, Ishihara Industry K.K.) | 90.7 g |
| Polyoxyethylene phenyl ether | 1 g |
| Sumitex Resin M-3 (8% aqueous solution) (water-soluble melamine compound, Sumitomo Chemical Industry K.K.) | 22.3 g |
| Distilled water | 866.9 g |

The coating solution C was applied onto the second layer and dried at 180° C. for 30 seconds, forming a third layer of 0.03 μm thick.

A coating solution D was prepared by mixing the following ingredients.

| | |
|---|---|
| Chemipearl S-120 (27% water dispersion) (polyolefin water dispersion, Mitsui Petro-Chemical K.K.) | 30 g |
| Snowtex C (30% water dispersion) (colloidal silica water dispersion, Nissan Chemical K.K.) | 20 g |
| Polystyrene sulfonate (Mw 1000–5000) | 1 g |
| Denacol EX614B (1% aqueous solution) (epoxy compound, Nagase Chemicals K.K.) | 30 g |
| Distilled water | 919 g |

The coating solution D was applied onto the third layer and dried at 170° C. for 30 seconds, forming a fourth layer of 0.03 μm thick. A back-coated sample (BC-A) was completed in this way.

Preparation of back-coated sample (BC-B)

A coating solution E was prepared by mixing the following ingredients.

| | |
|---|---|
| Jurimer ET410 (3.0% water dispersion) | 32.9 g |
| Gelatin | 6.3 g |
| Compound C | 0.02 g |
| FS-10D (17% water dispersion) (Sb-doped $SnO_2$ water dispersion, acicular particles, length/breadth 20–30, length 0.2–2.0 μm, breadth 0.01–0.02 μm Ishihara Industry K.K.) | 181.4 g |
| Polyoxyethylene phenyl ether | 1 g |
| Sumitex Resin M-3 (8% aqueous solution) (water soluble melamine compound, Sumitomo Chemical Industry K.K.) | |
| Dye A | 2.1 g |
| Matte agent: polymethyl methacrylate (mean particle size 4–5 μm) | 0.73 g |
| Distilled water | 735.6 g |

The coating solution E was applied to one surface (or back surface) of a PET film of 120 μm thick and dried at 180° C. for 30 seconds, forming a first layer which exhibited an absorbance of 0.8 at 780 nm.

A coating solution F was prepared by mixing the following ingredients.

| | |
|---|---|
| Chemipearl S-120 (27% water dispersion) (polyolefin water dispersion, Mitsui Petro-Chemical K.K.) | 90 g |
| Snowtex C (30% water dispersion) (colloidal silica water dispersion, Nissan Chemical K.K.) | 60 g |
| Polystyrene sulfonate (Mw 1000–5000) | 3 g |
| Denacol EX614B (1% aqueous solution) (epoxy compound, Nagase Chemicals K.K.) | 90 g |
| Distilled water | 757 g |

The coating solution F was applied onto the first layer and dried at 170° C. for 30 seconds, forming a second layer of 0.20 μm thick. A back-coated sample (BC-B) was completed in this way.

Preparation of undercoat on emulsion side

A coating solution G was prepared by mixing the following ingredients.

| | |
|---|---|
| Styrene/butadiene copolymer latex (styrene:butadiene = 67:30, solids 40 wt %) | 152 g |

-continued

| | |
|---|---|
| Polystyrene microparticulates (mean particle size 2 μm) | 0.1 g |
| Distilled water | 847.9 g |

The coating solution G was applied to the other surface of the back-coated sample (BC-A or BC-B) and dried at 180° C. for 30 seconds, forming a first undercoat layer of 0.3 μm thick.

A coating solution H was prepared by mixing the following ingredients.

| | |
|---|---|
| Gelatin | 15 g |
| Acetic acid (20% aqueous solution) | 10 g |
| Compound C | 0.04 g |
| Methyl cellulose (2% aqueous solution) | 23.3 g |
| Distilled water | 951.3 g |

The coating solution H was applied onto the first undercoat layer and dried at 170° C. for 30 seconds, forming a second undercoat layer of 0.15 μm thick. Undercoated samples (Base A corresponding to BC-A, and Base B corresponding to BC-B) were completed in this way.

A further undercoated sample (Base C) was prepared. First, a back-coated sample (BC-C) was prepared by the same procedure as the back-coated sample (BC-B) except that only the amount of the dye added was reduced to one half and the coating solution was applied so as to give an absorbance of 0.4 at 780 nm. The coating solution G was applied to the surface of the sample opposite to the back-coated side and dried at 180° C. for 30 seconds, forming a first undercoat layer of 0.3 μm thick. The coating solution B in which only the amount of the dye added was reduced to one half was applied onto the first undercoat layer and dried at 180° C. for 30 seconds, forming a second undercoat layer which exhibited by itself an absorbance of 0.4 at 780 nm. The undercoated sample (Base C) had an overall dye concentration to give an absorbance of 0.8.

The thus prepared samples having back coated and undercoated sides (Base-A, Base-B and Base-C) each were passed through a heat treating zone having an overall length of 200 m and set at 200° C. at a feed speed of 20 m/min under a tension of 3 kg/cm$^2$. Thereafter, the sample was passed through a zone set at 40° C. for 15 seconds and taken up into a roll under a tension of 10 kg/cm$^2$. The heat treated samples are designated Base-HA, Base-HB and Base-HC.

For comparison purposes, samples designated Base-JA, Base-JB and Base-JC were prepared by the same procedure as samples Base-HA, Base-HB and Base-HC except that instead of Dye A, a water-soluble Dye B was used in a coverage of 60 mg/m$^2$. Samples designated Base-HD, HE, HF, HG, JE, and JF were similarly prepared, using inventive Dyes 3, 4, 57a, 55a, and comparative Dyes E and F, respectively, instead of Dye A. It is noted that those dyes which were not in salt form were dissolved in an equimolar amount of triethylamine to form a solution before they were used in the preparation of samples.

A still further comparative sample Base-JD was prepared by starting with a PET film having a moisture-proof undercoat of vinylidene chloride on each surface and applying the following back side coating solution to a wet thickness of 80 μm.

The back side coating solution for comparison was prepared by dissolving the following ingredients in acetone and optionally, dimethylformamide.

| | |
|---|---|
| Polyvinyl butyral (Denka Butyral #4000-2 by Denki Kagaku Kogyo K.K.) | 7.5 g |
| CAB 171-15S (cellulose acetate butyrate, Eastman Chemical products, Inc.) | |
| Isopropyl alcohol | 150 ml |
| Dye D | 80 mg/m$^2$ |

The solution containing Dye D in a concentration of 2% was applied so as to give a coverage of 80 mg/m$^2$ of Dye D.

The compounds used have the following structural formulas. Note that Dye A corresponds to Dye 1a in the list of exemplary compounds of formula (I) according to the invention.

Compound C

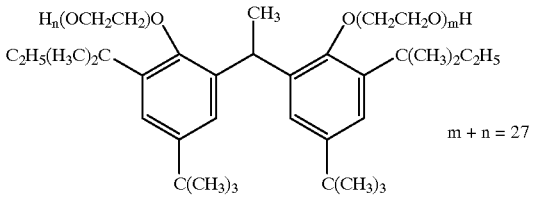

Dye A

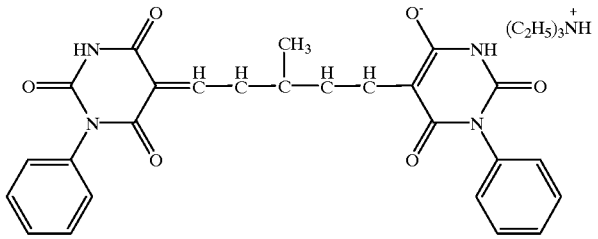

Water-soluble Dye B

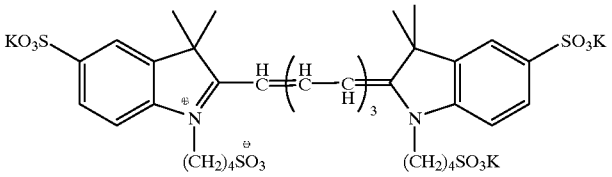

Dye D

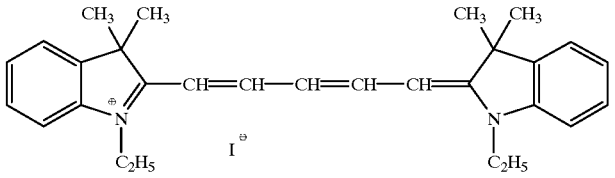

-continued

Dye E

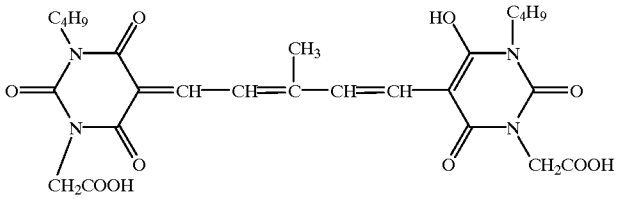

Dye F

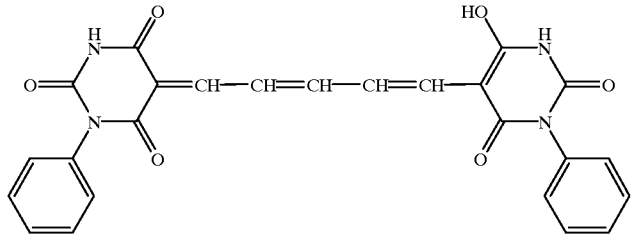

Measurement of λmax (1) Measurement of Film Absorption

Each of the above-described supports (shown in Table 1) was cut into a strip of 1 cm wide. Using a spectrophotometer model U-3410 (Hitachi K.K.), the strip was measured for absorbance over the range of 1,100 to 350 nm, from which λmax was determined.

(2) Measurement of DMF Solution Absorption

Each of the above-described dyes (shown in Table 1) was dissolved in DMF in a concentration of 5 mg/l, and a quartz cell was filled with the solution. Absorbance was measured over the range of 1,100 to 350 nm, from which λmax (DMF) was determined.

The results are shown in Table 1.

TABLE 1

| Support | Dye | λmax (DMF), nm | λmax (film absorption), nm | Remarks |
|---|---|---|---|---|
| Base-HA | A (1a) | 618 | 789 | Invention |
| Base-HB | A (1a) | 618 | 786 | Invention |
| Base-HC | A (1a) | 618 | 783 | Invention |
| Base-HD | 3 | 615 | 786 | Invention |
| Base-HE | 4 | 615 | 735 | Invention |
| Base-HF | 57a | 622 | 730 | Invention |
| Base-HG | 55a | 645 | 748 | Invention |
| Base-JA | B | 748 | 749 | Comparison |
| Base-JB | B | 748 | 750 | Comparison |
| Base-JC | B | 748 | 748 | Comparison |
| Base-JD | D | 800 | 797 | Comparison |
| Base-JE | E | 590 | 600 | Comparison |
| Base-JF | F | 594 | 602 | Comparison |

Example 1

Silver Halide Grains A

In 650 ml of water were dissolved 11 g of phthalated gelatin, 30 mg of potassium bromide, and 10 mg of sodium benzenethiosulfonate. The solution was adjusted to pH 5.0 at a temperature of 55° C. To the solution, 159 ml of an aqueous solution containing 18.6 g of silver nitrate and an aqueous solution containing 1 mol/liter of potassium bromide were added over 6½ minutes by the controlled double jet method while maintaining the solution at pAg 7.7. Then, 476 ml of an aqueous solution containing 55.5 g of silver nitrate and an aqueous solution containing 1 mol/liter of potassium bromide were added over 28½ minutes by the controlled double jet method while maintaining the solution at pAg 7.7. Thereafter, the pH of the solution was lowered to cause flocculation and sedimentation for desalting. Further, 0.17 g of Compound A and 23.7 g of deionized gelatin (calcium content below 20 ppm) were added to the solution, which was adjusted to pH 5.9 and pAg 8.0. There were obtained cubic grains of silver halide having a mean grain size of 0.11 μm, a coefficient of variation of the projected area of 8%, and a (100) face proportion of 93%.

The thus obtained silver halide grains were heated at 60° C., to which 76 μmol of sodium benzenethiosulfate was added per mol of silver. After 3 minutes, 154 μmol of sodium thiosulfate was added and the emulsion was ripened for 100 minutes.

Thereafter, the emulsion was maintained at 40° C., and with stirring, $6.4\times10^{-4}$ mol of Sensitizing Dye A and $6.4\times10^{-3}$ mol of Compound B were added per mol of silver halide. After 20 minutes, the emulsion was quenched to 30° C., completing the preparation of a silver halide emulsion A.

Sensitizing Dye A

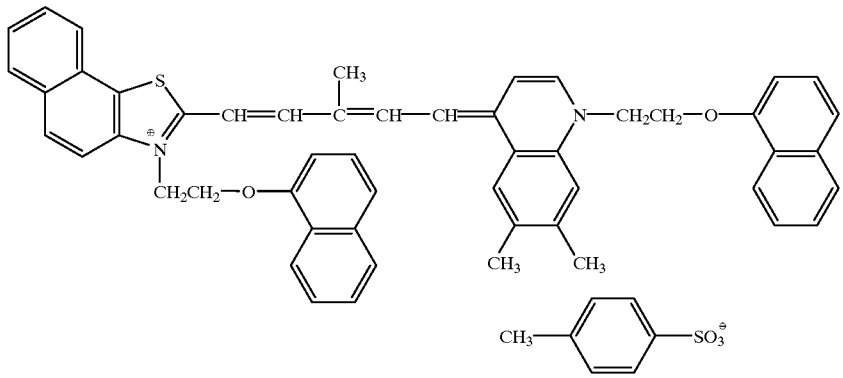

Compound A

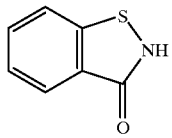

Compound B

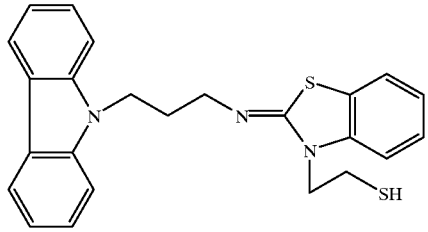

Organic Acid Silver Dispersion

While a mixture of 4.4 g of arachidic acid, 39.4 g of behenic acid, and 770 ml of distilled water was stirred at 85° C., 103 ml of 1N NaOH aqueous solution was added over 60 minutes. Reaction was carried out for 240 minutes. The solution was cooled to 75° C. Next, 112.5 ml of an aqueous solution containing 19.2 g of silver nitrate was added over 45 seconds to the solution, which was left to stand for 20 minutes and cooled to 30° C. Thereafter, the solids were separated by suction filtration and washed with water until the water filtrate reached a conductivity of 30 $\mu$S/cm.

The thus obtained solids were handled as a wet cake without drying. To 100 g as dry solids of the wet cake, 5 g of polyvinyl alcohol PVA-205 (Kurare K.K.) and water were added to a total weight of 500 g. This was pre-dispersed in a homomixer.

The pre-dispersed liquid was processed three times by a dispersing machine Micro-Fluidizer M-110S-EH (with G10Z interaction chamber, manufactured by Microfluidex International Corporation) which was operated under a pressure of 1,750 kg/cm$^2$. There was obtained an organic acid silver dispersion A. The organic acid silver grains in this dispersion were acicular grains having a mean minor axis (or breadth) of 0.04 $\mu$m, a mean major axis (or length) of 0.8 $\mu$m, and a coefficient of variation of 30%. It is noted that particle dimensions were measured by Master Sizer X (Malvern Instruments Ltd.). The desired dispersion temperature was set by mounting serpentine heat exchangers at the front and rear sides of the interaction chamber and adjusting the temperature of refrigerant.

Solid particle dispersion of 1,1-bis(2-hydroxy-3,5-dimethylphenyl)-3,5,5-trimethylhexane To 20 g of 1,1-bis(2-hydroxy-3,5-dimethylphenyl)-3,5,5-trimethylhexane were added 3.0 g of polyvinyl alcohol MP-203 (Kurare K.K.) and 77 ml of water. They were thoroughly agitated to form a slurry, which was allowed to stand for 3 hours. A vessel was charged with the slurry together with 360 g of zirconia beads having a mean diameter of 0.5 mm. A dispersing machine 1/4G Sand Grinder Mill (Imex K.K.) was operated for 3 hours for dispersion, obtaining a solid particle dispersion of the reducing agent in which particles with a diameter of 0.3 to 1.0 $\mu$m accounted for 80% by weight.

Solid Particle dispersion of tribromomethylphenylsulfone

To 30 g of tribromomethylphenylsulfone were added 0.5 g of hydroxypropylmethyl cellulose, 0.5 g of Compound C, and 88.5 g of water. They were thoroughly agitated to form a slurry, which was allowed to stand for 3 hours. Following the steps used in the preparation of the solid particle dispersion of the reducing agent, a solid particle dispersion of the antifoggant was prepared in which particles with a diameter of 0.3 to 1.0 $\mu$m accounted for 80% by weight.

| | | |
|---|---|---|
| LACSTAR 3307B (SBR latex, Tg 17° C., Dai-Nippon Ink & Chemicals K.K.) | as solids | 470 g |
| 1,1-bis(2-hydroxy-3,5-dimethylphenyl)-3,5,5-trimethylhexane | as solids | 110 g |
| Tribromomethylphenylsulfone | as solids | 25 g |
| Sodium benzenethiosulfonate | | 0.25 g |
| Polyvinyl alcohol MP-203 (Kurare K.K.) | | 46 g |
| 6-Isobutylphthalazine | | 0.12 mol |
| N-(2-methoxyphenyl)-N'-formylhydrazine | | 1.85 g |
| Silver halide emulsion A | as Ag | 0.05 mol |

Emulsion Surface Protective Layer Coating Solution

A surface protective layer coating solution was prepared by adding 3.75 g of $H_2O$ to 109 g of a polymer latex having a solids content of 27.5% (methyl methacrylate/styrene/2-ethylhexyl acrylate/2-hydroxyethyl methacrylate/methacrylic acid=59/9/26/5/1 copolymer, Tg 55° C.), then adding 4.5 g of benzyl alcohol as a film-forming aid, 0.45 g of Compound D, 0.125 g of Compound E, 0.0125 mol of Compound F, and 2.25 g of polyvinyl alcohol PVA-217 (Kurare K.K.), and diluting with water to a total weight of 150 g.

Compound D

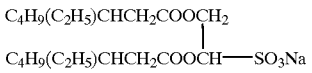

Compound E

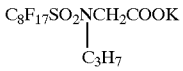

Compound F

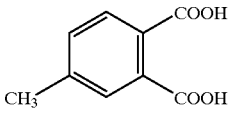

Photothermographic Element

The samples having back-coated and undercoated sides (Base-HA, Base-HB and Base-HC) were used as the support. The emulsion layer coating solution A was applied onto the undercoat layer of the support to a silver coverage of 1.6 g/m$^2$. The emulsion surface protective layer coating solution A was applied thereon so that the coverage of the polymer

TABLE 2

| Sample No. | Dye in Emulsion layer | Support | Remarks |
|---|---|---|---|
| 101 | none | Base-HA | Invention |
| 102 | none | Base-HB | Invention |
| 103 | none | Base-HC | Invention |
| 104 | none | Base-JA | Comparison |
| 105 | none | Base-JB | Comparison |
| 106 | none | Base-JC | Comparison |
| 107 | added | Base-HA | Invention |
| 108 | added | Base-HB | Invention |
| 109 | added | Base-HC | Invention |
| 110 | none | Base-JE | Comparison |
| 111 | none | Base-JF | Comparison |

Photographic Properties

The samples prepared above were exposed to xenon flash light for an emission time of $10^{-6}$ sec through an interference filter having a peak at 780 nm and a step wedge and heated for development by a heat drum at 115° C. for 25 seconds. The resulting images were measured for density relative to the exposure by a densitometer. From the results of measurement, Dmax and gradation γ (which is the gradient of a straight line connecting points of density 0.3 and 3.0 on the characteristic curve) were determined.

Dot sharpness (Image Quality) Test

Using laser light of 780 nm, a 50% screen tint of 100 lines was output to a coated sample, which was developed under the same conditions as above. Through a 100× magnifier, the image was visually observed for sharpness of dots. The results of evaluation were reported in Table 3 using a five-point scale between point 5 for good image quality and point 1 for poor image quality. Point 3 or higher is necessary for practical use.

Residual Color in Minimum Density Area

Three imaged samples were laid one on top of the other so that their minimum density areas overlapped. By a visual observation, the sample was rated "passed" when it was practically acceptable. Otherwise, that is, when the minimum density areas appeared bluish or greenish, the sample was rated "rejected."

The results are shown in Table 3.

TABLE 3

| Sample No. | γ | Image quality | Residual color | Remarks |
|---|---|---|---|---|
| 101 | 12.5 | 4 | Passed | Invention |
| 102 | 11.3 | 4 | Passed | Invention |
| 103 | 11.2 | 4 | Passed | Invention |
| 104 | 11.2 | 3 | Rejected | Comparison |
| 105 | 11.0 | 3 | Rejected | Comparison |
| 106 | 7.6 | 2 | Rejected | Comparison |
| 107 | 12.0 | 5 | Passed | Invention |
| 108 | 12.2 | 5 | Passed | Invention |
| 109 | 12.1 | 5 | Passed | Invention |
| 110 | 11.0 | 1 | Rejected | Comparison |
| 111 | 11.1 | 1 | Rejected | Comparison |

As seen from Table 3, the samples having the specific dye added to the back layer within the scope of the invention are photothermographic elements having minimal residual color and improved image quality. Especially, the samples (Nos. 107–109) in which the emulsion layer side is additionally dyed are remarkably improved in image quality. Dmax is fully high.

In contrast, sample Nos. 104–106 in which the comparative water-soluble dye is incorporated into the support are inferior in residual color. Sample No. 106 using support Base-JC in which the emulsion layer side of the support was dyed produced an image of poor quality with a low contrast and substantial residual color. The samples using supports Base-JE and Base-JF which did not have λmax at the exposure wavelength lacked antihalation effect and were inferior in residual color.

Example 2

Silver Halide Grains B

In 900 ml of water were dissolved 7.5 g of inert gelatin and 10 mg of potassium bromide. The solution was adjusted to pH 3.0 at a temperature of 35° C. To the solution, 370 ml of an aqueous solution containing 74 g of silver nitrate and an aqueous solution containing potassium bromide and potassium iodide in a molar ratio of 94:6 and $K_4[Fe(CN)_6]$ were added over 10 minutes by the controlled double jet method while maintaining the solution at pAg 7.7. Note that $[Fe(CN)_6]^{4-}$ was added in an amount of $3\times10^{-5}$ mol/mol of silver. Thereafter, 0.3 g of 4-hydroxy-6-methyl-1,3,3a,7-tetraazaindene was added to the solution, which was adjusted to pH 5 with NaOH. There were obtained cubic silver iodobromide grains B having a mean grain size of 0.06 μm, a coefficient of variation of projected area of 8%, and a {100} face ratio of 87%. The emulsion was desalted by adding a gelatin flocculant thereto to cause flocculation and sedimentation and then adjusted to pH 5.9 and pAg 7.5 by adding 0.1 g of phenoxyethanol.

Organic Acid Silver Emulsion B

A mixture of 10.6 g of behenic acid and 300 ml of distilled water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 7 ml of iN phosphoric acid aqueous solution was added thereto, and with more vigorous stirring, 0.13 g of N-bromosuccinimide was added. Thereafter, with stirring, the above-prepared silver halide grains B were added to the solution in such an amount as to give 2.5 mmol of silver halide. Further, 25 ml of 1N silver nitrate aqueous solution was continuously added over 2 minutes, with stirring continued for a further 90 minutes. With stirring, 37 g of a 1.2 wt % n-butyl acetate solution of polyvinyl acetate was slowly added to the aqueous mixture to form flocs in the dispersion. Water was removed, and water washing and water removal were repeated twice. With stirring, 20 g of a solution of 2.5% by weight polyvinyl butyral (Denka Butyral #3000-K by Denki Kagaku Kogyo K.K.) in a 1/2 solvent mixture of butyl acetate and 2-butanone was added. To the thus obtained gel-like mixture of organic acid silver and silver halide, 7.8 g of polyvinyl butyral (Denka Butyral #4000-2 by Denki Kagaku Kogyo K.K.) and 57 g of 2-butanone were added. The mixture was dispersed by a homogenizer, obtaining a silver behenate emulsion of acicular grains having a mean breadth of 0.04 μm, a mean length of 1 μm and a coefficient of variation of 30%.

| | |
|---|---|
| Sodium phenylthiosulfonate | 10 mg |
| Sensitizing dye-1 | 5.5 mg |
| 2-mercapto-5-methylbenzimidazole | 2 g |
| 2-mercapto-5-methylbenzothiazole | 1 g |
| 4-chlorobenzophenone-2-carboxylic acid | 21.5 g |
| 2-butanone | 580 g |
| Dimethylformamide | 220 g |

The emulsion was allowed to stand for 3 hours. With stirring, the following chemicals were further added.

| | |
|---|---|
| 4,6-ditrichloromethyl-2-phenyltriazine | 4.5 g |
| Disulfide compound A | 2 g |
| 1,1-bis(2-hydroxy-3,5-dimethylphenyl)-3,5,5-trimethylhexane | 160 g |
| Phthalazine | 15 g |
| Tetrachlorophthalic acid | 5 g |
| N-(2-methoxyphenyl)-N'-formylhydrazine | 1.1 g |
| Megaface F-176P (fluorochemical surfactant by Dai-Nippon Ink & Chemicals K.K.) | 1.1 g |
| 2-butanone | 590 g |
| Methyl isobutyl ketone | 10 g |
| Dye (2% DMF solution) | 1.5 g |

Note that Sensitizing Dye-1, Disulfide Compound A, and Dye C are shown below.

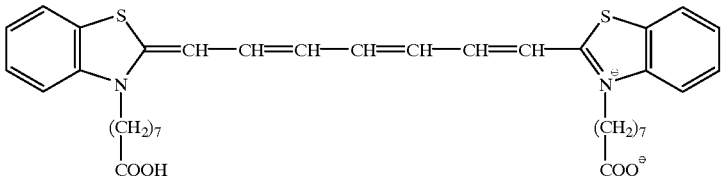

Disulfide compound A

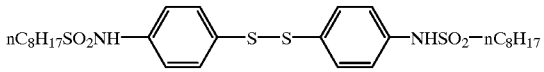

Dye C

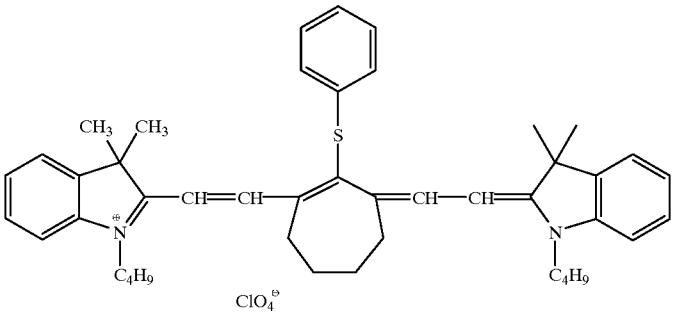

| | |
|---|---|
| CAB 171-15S (cellulose acetate butyrate, Eastman Chemical Products, Inc.) | 75 g |
| 4-methylphthalic acid | 5.7 g |
| Tetrachlorophthalic anhydride | 1.5 g |
| 2-tribromomethylsulfonylbenzothiazole | 10 g |
| Phthalazone | 2 g |
| Megaface F-176P | 0.3 g |
| Sildex H31 (spherical silica, mean particle size 3 μm, Dokai Chemical K.K.) | 2 g |
| Sumidur N3500 (polyisocyanate, Sumitomo-Bayer Urethane K.K.) | 5 g |
| 2-butanone | 3070 g |
| Ethyl acetate | 30 g |

Onto the above-prepared supports (shown in Table 4), the emulsion layer coating solution was applied so as to give a silver coverage of 2 g/m$^2$, and the emulsion surface protective layer coating solution was applied on the emulsion layer to a dry thickness of 5 μm. In this way, sample Nos. 201 to 207 were obtained.

TABLE 4

| Sample No. | Dye in emulsion layer | Support | Remarks |
|---|---|---|---|
| 201 | added | Base-HA | Invention |
| 202 | added | Base-HB | Invention |
| 203 | added | Base-HC | Invention |
| 204 | added | Base-JA | Comparison |
| 205 | added | Base-JB | Comparison |
| 206 | added | Base-JC | Comparison |
| 207 | added | Base-JD | Comparison |

As in Example 1, the samples were examined for photographic properties, dot sharpness, and residual color. The results are shown in Table 5.

TABLE 5

| Sample No. | γ | Image Quality | Residual color | Remarks |
|---|---|---|---|---|
| 201 | 12.5 | 5 | Passed | Invention |
| 202 | 11.3 | 5 | Passed | Invention |
| 203 | 11.2 | 5 | Passed | Invention |
| 204 | 11.2 | 4 | Rejected | Comparison |
| 205 | 11.0 | 4 | Rejected | Comparison |
| 206 | 7.6 | 2 | Rejected | Comparison |
| 207 | 11.0 | 4 | Rejected | Comparison |

As seen from Table 5, the samples having the specific dye added to the back layer within the scope of the invention are photothermographic elements having minimal residual color and improved image quality. Dmax is fully high.

In contrast, sample Nos. 204–206 in which the comparative water-soluble dye is incorporated into the support are inferior in residual color. Sample No. 207 in which the comparative oil-soluble indolenine dye is incorporated into the support is also inferior in residual color.

Example 3

Photothermographic element samples were prepared as in Example 1 except that 5.25 g of the inventive compound C-42 was used instead of 1.85 g of the N-(2-methoxyphenyl)-N'-formylhydrazine contrast enhancer used in Example 1.

As in Example 1, the samples having the specific dye added to the back layer within the scope of the invention are photothermographic elements having minimal residual color and improved image quality.

In contrast, the samples in which the comparative water-soluble dye is incorporated into the support are inferior in residual color. The sample using support Base-JC in which the emulsion layer side of the support was dyed produced an image of poor quality with a low contrast and substantial residual color.

Example 4

Photothermographic element samples were prepared as in Example 2 except that 3.1 g of the inventive compound C-42 was used instead of 1.1 g of the N-(2-methoxyphenyl)-N'-formylhydrazine contrast enhancer used in Example 2.

As in Example 2, the samples having the specific dye added to the back layer within the scope of the invention are photothermographic elements having minimal residual color and improved image quality.

In contrast, the samples in which the comparative water-soluble dye is incorporated into the support and the sample in which the comparative oil-soluble indolenine dye is incorporated into the support are inferior in residual color.

There has been described a photothermographic element comprising a photosensitive layer containing an organic silver salt, a silver halide, and a reducing agent on one surface of a support, and a back layer on the other surface of the support, the outermost back layer being based on a polymer latex binder, and the back layer containing a dye of formula (I) satisfying a specific maximum absorption wavelength relationship. The element produces an image with minimized residual color and high resolution.

Japanese Patent Application No. 41300/1998 is incorporated herein by reference.

Reasonable modifications and variations are possible from the foregoing disclosure without departing from either the spirit or scope of the present invention as defined by the claims.

What is claimed is:

1. A photothermographic element comprising a support having a pair of opposed surfaces, a photosensitive layer containing an organic silver salt, a silver halide, and a reducing agent on one surface of the support, and at least one back layer on the other surface of the support, the outermost layer of said at least one back layer being based on a binder containing at least 50% by weight of a polymer latex, wherein said back layer contains a dye of the following formula (I):

(I)

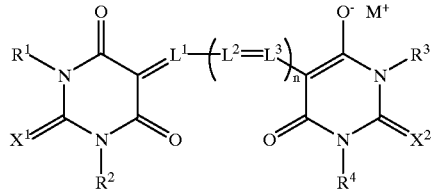

wherein $R^1$, $R^2$, $R^3$, and $R^4$ are independently hydrogen, aliphatic, aromatic or heterocyclic groups, $X^1$ and $X^2$ are independently oxygen or sulfur atoms, $L^1$, $L^2$, and $L^3$ are independently methine groups, letter n is equal to 0, 1, 2 or 3, and $M^+$ is a hydrogen atom or an inorganic or organic cation, with the proviso that $R^1$, $R^2$, $R^3$, $R^4$, $L^1$, $L^2$, and $L^3$ are free of groups having ionizable proton or salts thereof, and at least one of $L^1$, $L^2$, and $L^3$ has a substituent in case of n=2, and said dye has a maximum absorption wavelength λmax (nm) in the layer satisfying the relationship represented by the following formula (II):

$$\lambda max > \{\lambda max(DMF) + 20 \times (n+1)\} \quad \text{(II)}$$

wherein λmax(DMF) is the maximum absorption wavelength (nm) of the dye in a dimethylformamide solution and n is as defined in formula (I).

2. The photothermographic element of claim 1 wherein the outermost layer of said at least one back layer is based on a binder containing at least 70% by weight of a polymer latex.

3. The photothermographic element of claim 1 wherein the dye of formula (I) is represented by the following formula (Ia):

(Ia)

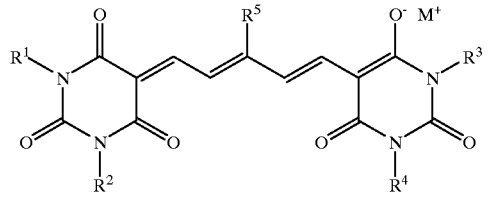

wherein $R^1$ to $R^4$ and $M^+$ are as defined in formula (I), and $R^5$ is a substituent selected from the group consisting of methyl, ethyl, benzyl, phenyl, phenoxy, benzoyl, hydroxy, chloro, amino, piperidino, morpholino, and dimethylcarbamoyl.

4. The photothermographic element of claim 1 wherein the dye of formula (I) is contained in the photosensitive layer as well as the back layer.

5. The photothermographic element of claim 1 wherein in formula (I), $M^+$ is a counter cation of H, Li, Na, K, Ca, triethylammonium or pyridinium.

* * * * *